US010723583B2

(12) United States Patent
Maki

(10) Patent No.: US 10,723,583 B2
(45) Date of Patent: Jul. 28, 2020

(54) METHOD FOR MANUFACTURING COIL COMPONENT AND WINDING DEVICE

(71) Applicant: Murata Manufacturing Co., Ltd., Kyoto-fu (JP)

(72) Inventor: Kenichiro Maki, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 226 days.

(21) Appl. No.: 16/009,041

(22) Filed: Jun. 14, 2018

(65) Prior Publication Data

US 2018/0370752 A1 Dec. 27, 2018

(30) Foreign Application Priority Data

Jun. 23, 2017 (JP) ..... 2017-123038

(51) Int. Cl.

| | |
|---|---|
| ***B65H 54/00*** | (2006.01) |
| ***B65H 54/02*** | (2006.01) |
| ***B65H 54/12*** | (2006.01) |
| ***H01F 41/082*** | (2016.01) |
| ***H01F 41/096*** | (2016.01) |
| ***B65H 54/28*** | (2006.01) |
| ***H01F 41/094*** | (2016.01) |
| *H01F 17/04* | (2006.01) |
| *H01F 17/00* | (2006.01) |
| *H01F 41/07* | (2016.01) |

(52) U.S. Cl.

CPC ..... *B65H 54/026* (2013.01); *B65H 54/12* (2013.01); *B65H 54/2896* (2013.01); *H01F 41/082* (2016.01); *H01F 41/094* (2016.01); *H01F 41/096* (2016.01); *B65H 2701/36* (2013.01); *H01F 17/045* (2013.01); *H01F 41/07* (2016.01); *H01F 2017/0093* (2013.01)

(58) Field of Classification Search

CPC .. B65H 2701/36; B65H 54/026; B65H 54/10; B65H 54/12; B65H 54/14; H01F 17/045; H01F 41/07; H01F 41/094; H01F 41/096

See application file for complete search history.

(56) References Cited

U.S. PATENT DOCUMENTS

2005/0237141 A1* 10/2005 Hirai ..... H01F 17/045 336/83
2016/0379756 A1* 12/2016 Yamakita ..... H01F 41/069 242/439.1

FOREIGN PATENT DOCUMENTS

| | | | |
|---|---|---|---|
| CN | 106298228 | A | 1/2017 |
| JP | S5710663 | B2 | 2/1982 |
| JP | 2017-011132 | A | 1/2017 |

OTHER PUBLICATIONS

An Office Action; "Notification of Reasons for Refusal," Mailed by the Japanese Patent Office dated Aug. 6, 2019, which corresponds to Japanese Patent Application No. 2017-123038 and is related to U.S. Appl. No. 16/009,041; with English language translation.

* cited by examiner

*Primary Examiner* — Emmanuel M Marcelo
(74) *Attorney, Agent, or Firm* — Studebaker & Brackett PC

(57) ABSTRACT

A method for manufacturing a coil component that can contribute to prevention of durability degradation of a wire. The method includes winding a plurality of wires, that are supplied from a wire supply source to a nozzle through a tensioner, around a core by revolving the core around the nozzle. Also, during the winding, the core is rotated in a direction same as or opposite to a revolution direction of the core.

8 Claims, 32 Drawing Sheets

METHOD FOR MANUFACTURING COIL COMPONENT AND WINDING DEVICE

CROSS-REFERENCE TO RELATED APPLICATION

This application claims benefit of priority to Japanese Patent Application No. 2017-123038, filed Jun. 23, 2017, the entire content of which is incorporated herein by reference.

BACKGROUND

Technical Field

The present disclosure relates to a method for manufacturing a coil component and a winding device.

Background Art

Japanese Patent Application Laid-Open No. 2017-11132 discloses a coil component including a core and a plurality of wires wound around the core. The winding device described in Japanese Patent Application Laid-Open No. 2017-11132 includes a chuck that grips a core, a coil bobbin around which a wire is wound, and a nozzle to which a wire drawn out from the coil bobbin is supplied. The winding device also includes a tensioner. The wire pulled out from the coil bobbin is routed to the nozzle while being hooked on the tensioner. The tensioner adjusts tension of the wire. The nozzle includes two tubular insertion bodies and a coupling body connecting the insertion bodies. Two wires are supplied to the nozzle, one of the wires is inserted in one of the insertion bodies, and the other wire is inserted in the other insertion body. Japanese Patent Application Laid-Open No. 2017-11132 discloses a method for manufacturing a coil component in which after leading ends of two wires inserted in the insertion bodies of the nozzle are fixed to electrodes of the core, the nozzle is revolved around the core in the winding device, whereby each wire is wound around the core to manufacture a coil component.

SUMMARY

In the method for manufacturing a coil component described in Japanese Patent Application Laid-Open No. 2017-11132, the nozzle is revolved around the core when the wires are wound around the core. In the winding device, a revolution center of each nozzle insertion body is displaced from the revolution center during the revolution of the nozzle. A position of the tensioner is kept constant. For this reason, a distance between each nozzle insertion body and the tensioner changes when the nozzle is revolved. The tension of the wire changes between the insertion body and the tensioner when the distance between the nozzle insertion body and the tensioner changes. The change in tension is repeatedly generated by the revolution of the nozzle. Consequently, in the manufacturing method described in Japanese Patent Application Laid-Open No. 2017-11132, durability of the wire may be degraded in the process of winding the wire around the core.

According to one aspect of the present disclosure, there is provided a method for manufacturing a coil component in which a plurality of wires are wound around a core, the method including a winding step of winding the plurality of wires supplied from a wire supply source to a nozzle through a tensioner around the core by revolving the core around the nozzle.

In the above method, in the winding step of winding the wire around the core, the nozzle is not revolved around the core, but the core is revolved around the nozzle. Consequently, the change in distance between the nozzle and the tensioner can be prevented when the wire is wound around the core. Thus, in the above method, compared with the method in which the nozzle is revolved around the core to wind the wire around the core, the change in tension of the wire can be prevented between the nozzle and the tensioner to contribute to the prevention of the durability degradation of the wire.

In the method for manufacturing a coil component, in the winding step, the core is preferably rotated in a direction identical or opposite to a revolution direction of the core.

When the core is revolved around the nozzle to wind a plurality of wires around the core, sometimes the wires are twisted. In this case, the wires are wound around the core while twisted. The number of twists of the wires changes by the rotation of the core. In the above method, the core is rotated while revolved in the winding step. Consequently, the number of twists of the wires can be changed when the plurality of wires are wound around the core.

According to another aspect of the present disclosure, there is provided a winding device that manufactures a coil component in which a plurality of wires are wound around a core. The winding device includes a nozzle in which the plurality of wires pulled out from a wire supply source are inserted; a tensioner that adjusts tension of the plurality of wires inserted in the nozzle; and a holding unit that holds the core. The winding device further includes a revolution drive unit that revolves the core around the nozzle; and a first controller that controls the revolution drive unit to revolve the core around the nozzle, and winds the wire inserted in the nozzle around the core.

In the above configuration, the revolution drive unit that revolves the core around the nozzle is provided, and the first controller controls the revolution drive unit, and revolves the core around the nozzle to wind the plurality of wires around the core. Consequently, the change in distance between the nozzle and the tensioner can be prevented when the plurality of wires are wound around the core. Thus, in the above configuration, compared with the configuration in which the nozzle is revolved around the core to wind the wire around the core, the change in tension of the wire can be prevented between the nozzle and the tensioner to contribute to the prevention of the durability degradation of the wire.

Preferably the winding device further includes a rotation drive unit that rotates the core in a direction identical or opposite to a revolution direction of the core by the revolution drive unit; and a second controller that controls the rotation drive unit to rotate the core when the first controller controls the revolution drive unit to revolve the core around the nozzle.

When the core is revolved around the nozzle to wind a plurality of wires around the core, sometimes the wires are twisted. In this case, the wires are wound around the core while twisted. The number of twists of the wires changes by the rotation of the core. In the above configuration, the rotation drive unit that rotates the core is provided, and the second controller controls the rotation drive unit to rotate the core when the core revolves around the nozzle. Consequently, the number of twists of the wires can be changed when the plurality of wires are wound around the core.

DETAILED DESCRIPTION

Figure 1:
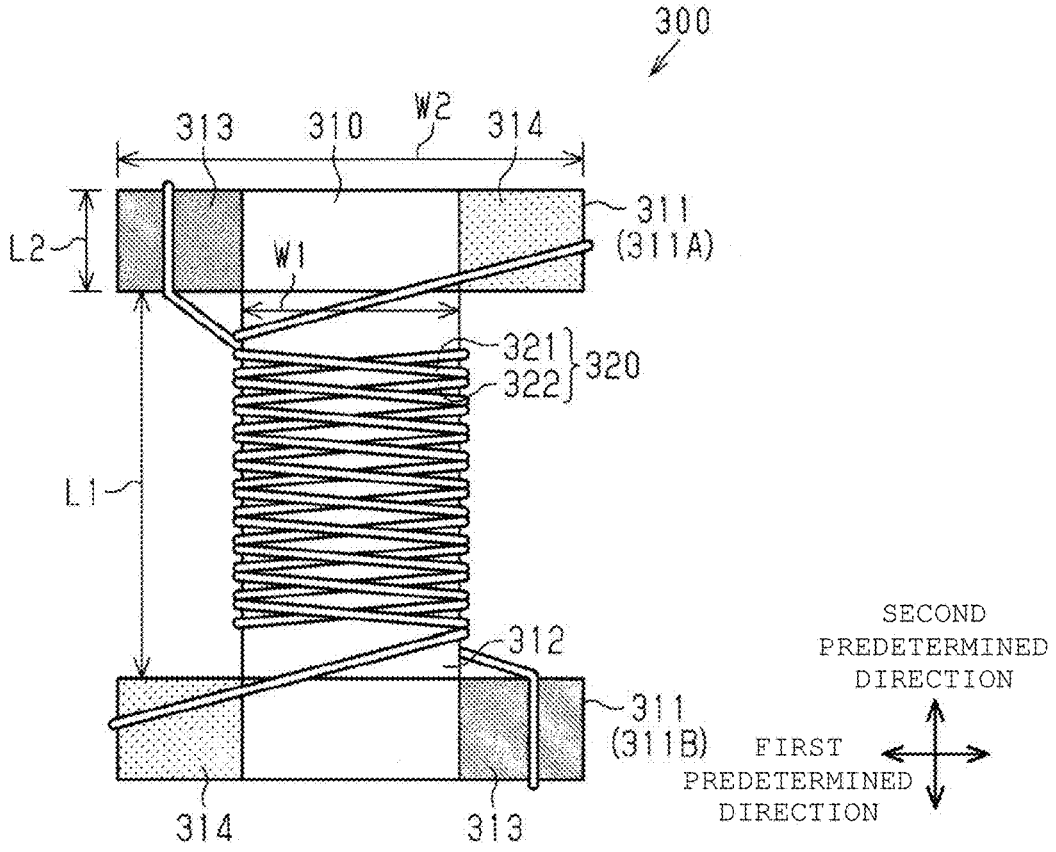
FIG. 1 is a plan view of a coil component.

An embodiment of a method for manufacturing a coil component and a winding device will be described with reference to FIGS. 1 to 19. In the drawings, sometimes a component is illustrated while enlarged for the sake of easy understanding. Also, sometimes a dimension ratio of a component differs from an actual dimension ratio or a dimension ratio in another drawing. In the sectional view, sometimes hatting of a part of the components is omitted for the sake of easy understanding.

As illustrated in FIG. 1, a coil component 300 includes a core 310 and a plurality of wires 320 wound around the core 310. The core 310 includes a pair of flanges 311. One of the flanges 311 (an upper side in FIG. 1) is referred to as a first flange 311A, and the other flange (a lower side in FIG. 1) is referred to as a second flange 311B. The first flange 311A and the second flange 311B are formed into a rectangular parallelepiped shape, and have the same shape. The first flange 311A and the second flange 311B are disposed opposite each other. A winding core 312 is disposed between the first flange 311A and the second flange 311B. The winding core 312 is formed into a rectangular parallelepiped shape, one end of the winding core 312 is connected to the first flange 311A, and the other end is connected to the second flange 311B. In a first predetermined direction (a crosswise direction in FIG. 1) of the coil component 300, the winding core 312 is connected to the central portion of the pair of flanges 311. A dimension W1 in the first predetermined direction of the winding core 312 is shorter than a dimension W2 in the first predetermined direction of the pair of flanges 311 (W1<W2). In a second predetermined direction (a vertical direction in FIG. 1) orthogonal to the first predetermined direction, a dimension L1 of the winding core 312 is longer than a dimension L2 of the pair of flanges 311 (L1>L2).

Figure 2:
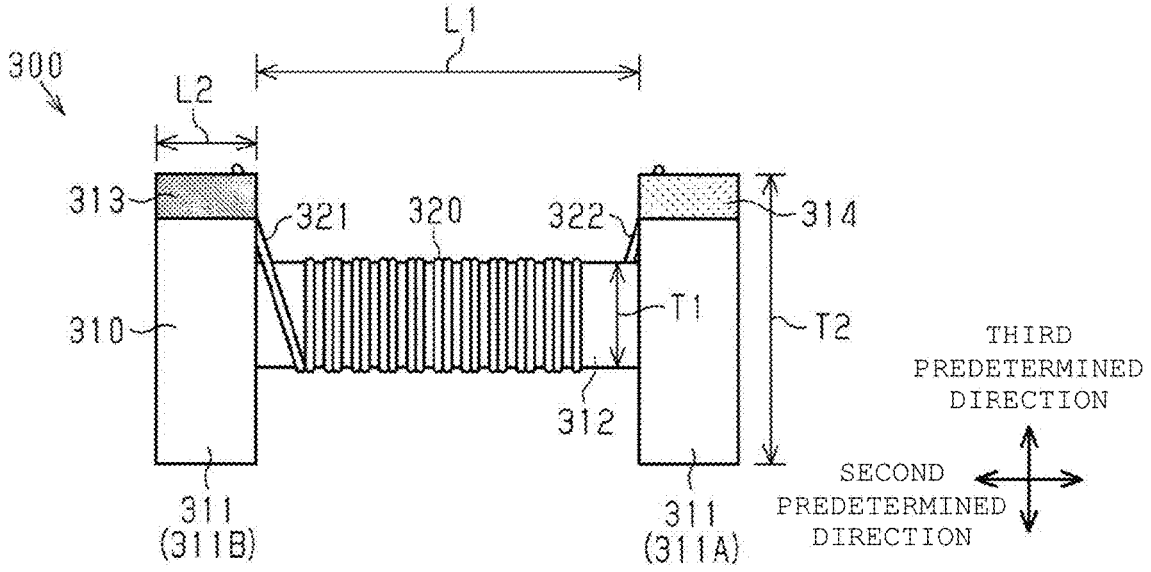
FIG. 2 is a side view of the coil component.

FIG. 2 is a side view of the coil component 300 when the coil component 300 is viewed from the right in FIG. 1. As illustrated in FIG. 2, the winding core 312 is connected to the central portion of the pair of flanges 311 in a third predetermined direction (the vertical direction in FIG. 2) orthogonal to both the first predetermined direction (a depth direction in FIG. 2) and the second predetermined direction (the crosswise direction in FIG. 2) of the coil component 300. A dimension T1 of the winding core 312 in the third predetermined direction is shorter than a dimension T2 of the pair of flanges 311 in the third predetermined direction (T1<T2). Consequently, in the core 310, the first flange 311A and the second flange 311B are disposed at both ends in the second predetermined direction of the winding core 312, and the pair of flanges 311 extends from the winding core 312 to the outside in the first predetermined direction and the outside in the third predetermined direction.

A material having magnetism (such as nickel (Ni)-zinc (Zn) type ferrite, manganese (Mn)—Zn type ferrite, and metallic magnetic material) or a material having no magnetism (such as alumina and resin) can be used as a constituting material of the core 310. The core 310 is formed by molding and sintering powders of the constituent material, and the pair of flanges 311 and the winding core 312 are formed as an integral body. A shape and a dimension of the core 310 may be appropriately set so as to satisfy the necessary shape and dimension in a circuit board on which the coil component 300 is mounted.

A first electrode 313 and a second electrode 314 are provided on the first flange 311A and the second flange 311B, respectively. As illustrated in FIG. 1, in the first flange 311A, the first electrode 313 is disposed on one side (a left side in FIG. 1) in the first predetermined direction, and the second electrode 314 is provided on the other side (a right side in FIG. 1). In the second flange 311B, the first electrode 313 is disposed on the other side (the right side in FIG. 1) in the first predetermined direction, and the second electrode 314 is disposed on one side (the left side in FIG. 1). As illustrated in FIG. 2, the electrodes 313, 314 are disposed only on one side (the upper side in FIG. 2) in the third predetermined direction. Each of the electrodes 313, 314 includes a metallic layer and a plating layer laminated on a surface of the metallic layer. Metal such as silver (Ag) and copper (Cu) or an alloy such as nickel (Ni)-chromium (Cr) and Ni—Cu can be used as a material for the metal layer. Metal such as tin (Sn) and Ni or an alloy such as Ni—Sn can be used as a material for the plating layer. The plating layer may have a multilayer structure.

As illustrated in FIG. 1, two wires 320, namely, a first wire 321 and a second wire 322, are wound around the core 310. One end of the first wire 321 is connected to the first electrode 313 provided in the first flange 311A, and the other end is connected to the first electrode 313 provided in the second flange 311B. The first wire 321 is wound around the winding core 312 between both ends of the first wire 321. This enables a primary-side coil to be formed. One end of the second wire 322 is connected to the second electrode 314 provided in the first flange 311A, and the other end is connected to the second electrode 314 provided in the second flange 311B. The second wire 322 is wound around the winding core portion 312 between both ends of the second wire 322. This enables a secondary-side coil to be formed. The first wire 321 and the second wire 322, which are wound around the winding core 312, are mutually twisted and intersected. Each of the first wire 321 and the second wire 322 includes a conductive core wire and an insulating coating material covering the core wire. For example, Cu or Ag can be used as a main material for the core wire. For example, polyurethane or polyester can be used as a material for the coating material.

As described above, the coil component 300 including the primary-side coil and the secondary-side coil functions as a surface mount type common mode choke coil mounted on, for example, a circuit board.

<Coil Component Manufacturing Apparatus>

Figure 3:
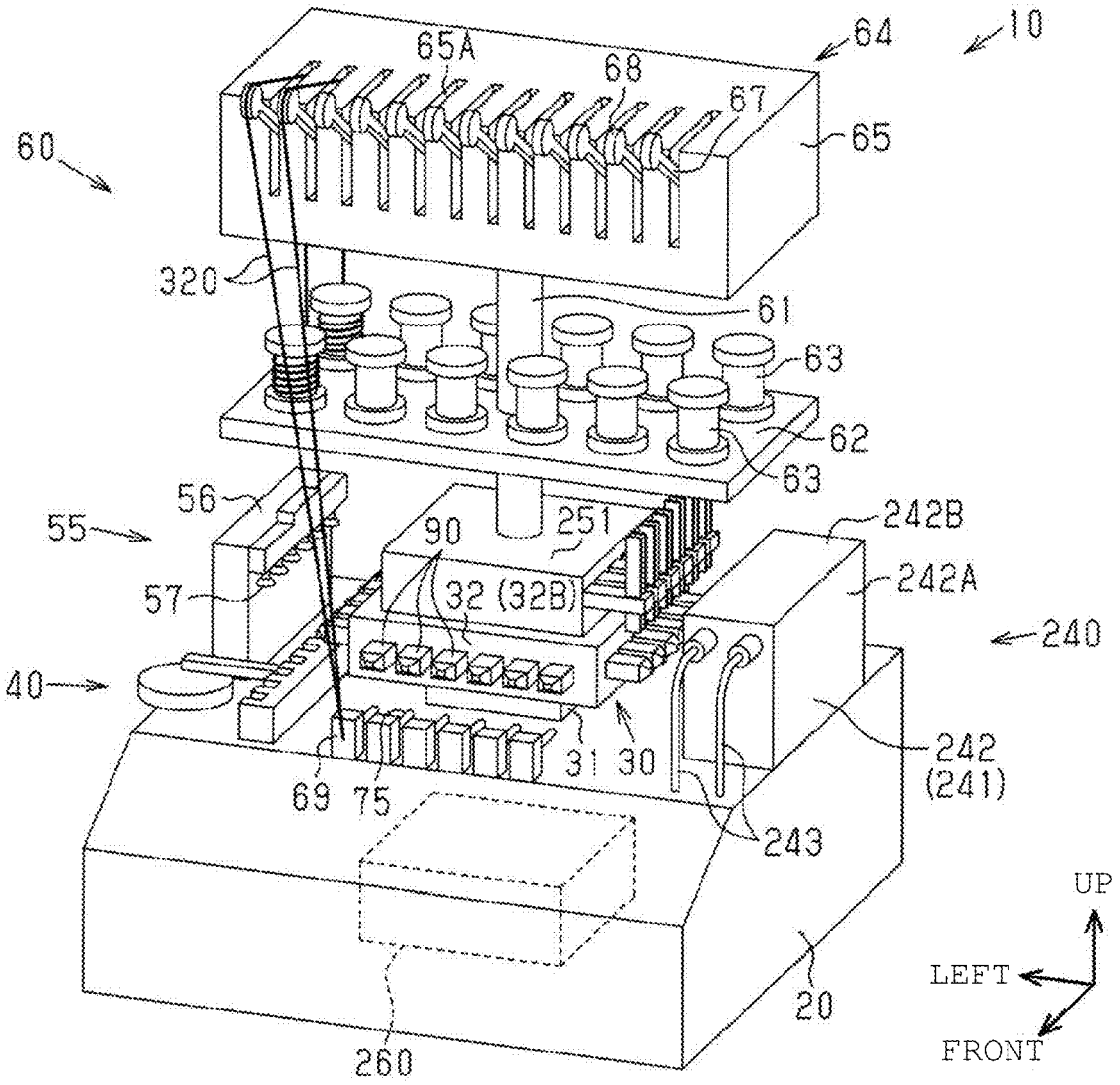
FIG. 3 is a perspective view illustrating a schematic configuration of a coil component manufacturing apparatus including a winding device according to an embodiment.

As illustrated in FIG. 3, a coil component manufacturing apparatus 10 includes a base 20. The base 20 is formed into a substantially trapezoidal shape. A rotating device 30 is disposed in a center of an upper surface of the base 20.

Figure 4:
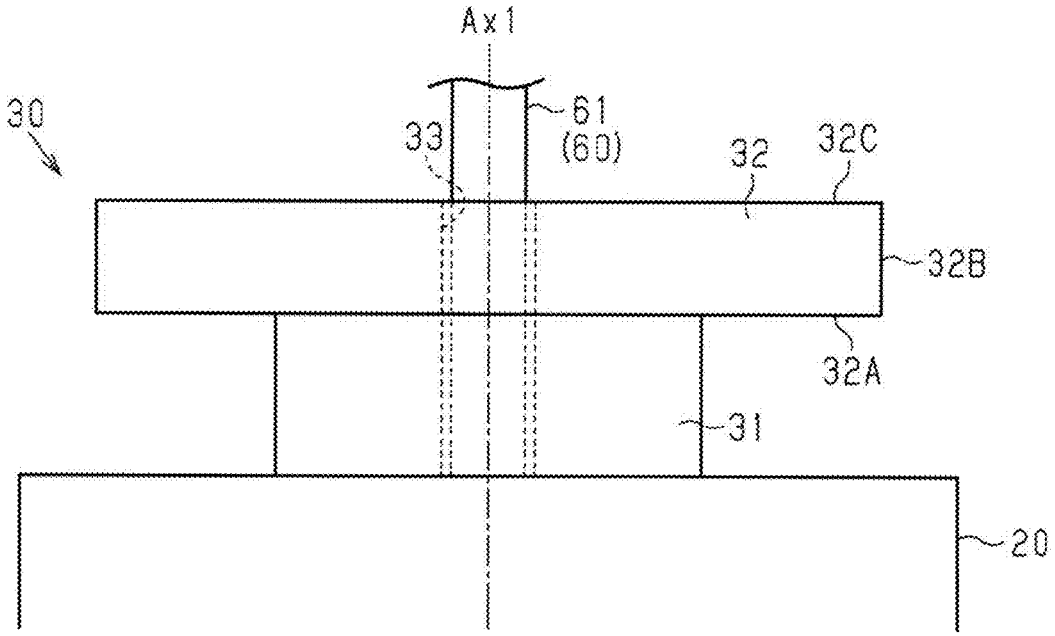
FIG. 4 is a side view of a rotating device.

As illustrated in FIG. 4, the rotating device 30 includes a direct drive motor 31 fixed to the upper surface of the base 20. An index table 32 is connected to an upper end of the direct drive motor 31. The index table 32 is formed into a square box shape, and includes a bottom wall 32A, a side wall 32B vertically provided from a peripheral edge of the bottom wall 32A, and an upper wall 32C connecting the upper end of the side wall 32B. A lower surface of the bottom wall 32A is disposed in parallel to an upper surface of the base 20. Each side wall 32B has a predetermined thickness. Although not illustrated, a plurality of cylindrical holes having a cylindrical shape are provided in a longitudinal direction (the crosswise direction in FIG. 4) of the side wall 32B. The inside and the outside of the index table communicate with each other by the cylindrical hole. A through-hole 33 extending perpendicularly with respect to the upper surface of the base 20 is formed in the center between the direct drive motor 31 and the index table 32. The direct drive motor 31 is driven by energization, and rotates the index table 32 about a central axial line Ax1 of the through-hole 33 while keeping the upper surface of the base 20 and the lower surface of the index table 32 in parallel to each other. Consequently, the index table 32 rotates relative to the base 20.

As illustrated in FIG. 3, a core supply device 40, a core input device 55, a wire winding device 60, and a wire bonding device 240 are disposed on the upper surface of the base 20. The wire winding device 60 includes a nozzle moving device 69 connected to the upper surface of the base 20, and the wire 320 is routed in the nozzle moving device 69. In the base 20, the side on which the core supply device 40 and the core input device 55 are disposed is referred to as the left side, and the side on which the wire bonding device 240 is disposed is referred to as the right side. In the base 20, the side on which the nozzle moving device 69 of the wire winding device 60 is disposed is referred to as the front side, and the opposite side to the front side is referred to as the rear side. These devices 40, 55, 60, 240 are disposed separately from the rotating device 30 so as not to interrupt rotating operation of the rotating device 30.

The rotating device 30 rotates the index table 32 such that the side wall 32B of the index table 32 is sequentially disposed on the left side, the front side, the right side, and the rear side of the base 20. A control device 260 that controls the devices 40, 55, 60, 240 is also provided in the coil component manufacturing apparatus 10. The control device 260 is accommodated in the base 20, and is electrically connected to the devices 40, 55, 60, 240.

(Core Supply Device)

The configuration of the core supply device 40 is similar to that of a known device that conveys the core 310. The outline of the core supply device 40 will be described below.

Figure 5:
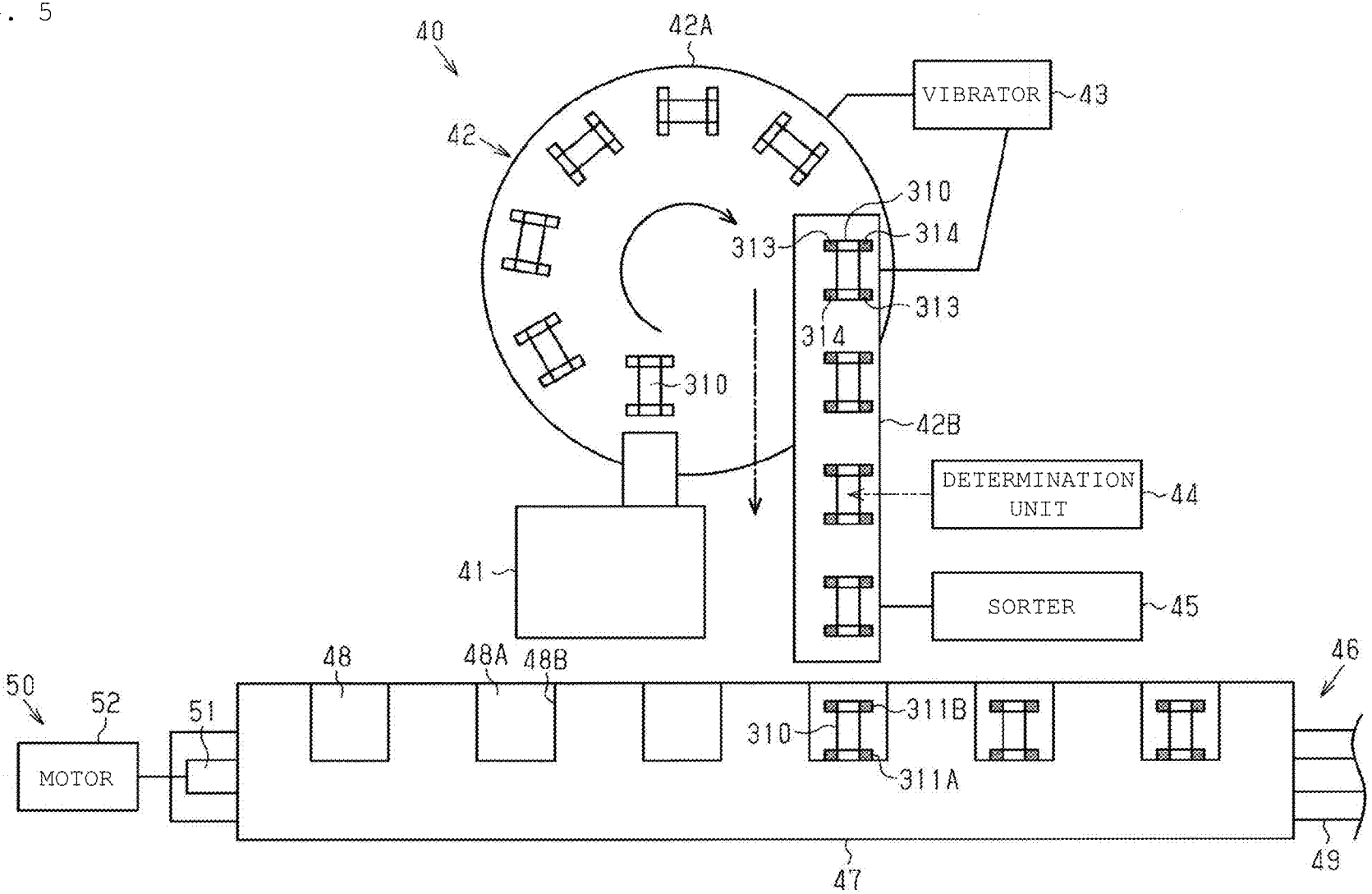
FIG. 5 is a schematic diagram illustrating a schematic configuration of a core supply device.

As illustrated in FIG. 5, the core supply device 40 includes a reserve unit 41 that stores a large number of cores 310 and a feeder 42 to which the core 310 is supplied from the reserve unit 41. The feeder 42 includes a circumferential-direction conveyer 42A formed into a circular shape in planar view and a straight advancing conveyer 42B formed into a rectangular shape. One end of the straight advancing conveyer 42B is connected to the circumferential-direction conveyer 42A, and the other end is disposed outside the circumferential-direction conveyer 42A. The feeder 42 also includes a vibrator 43 that vibrates the circumferential-direction conveyer 42A and the straight advancing conveyer 42B. The vibrator 43 vibrates the circumferential-direction conveyer 42A to move the core 310 supplied from the reserve unit 41 to the circumferential-direction conveyer 42A in the circumferential direction of the circumferential-direction conveyer 42A, and conveys the core 310 to the straight advancing conveyer 42B as indicated by a solid line arrow in FIG. 5. The vibrator 43 vibrates the straight advancing conveyer 42B to move the core 310 conveyed from the circumferential-direction conveyer 42A to the straight advancing conveyer 42B in a straight advancing direction as indicated by a dashed-line arrow in FIG. 5, and conveys the core 310 to the outside of the circumferential-direction conveyer 42A.

The core supply device 40 includes a determination unit 44 that determines whether the core 310 conveyed by the straight advancing conveyer 42B is disposed in a predetermined direction and a sorter 45 that returns the core 310 that is not disposed in the predetermined direction to the reserve unit 41. For example, the determination unit 44 includes a camera. In the determination unit 44, the core 310 located at a predetermined determination position on the straight advancing conveyer 42B is photographed by the camera, and the determination is made based on the photographed image. That is, the determination unit 44 determines that the core 310 is disposed in the predetermined orientation when a predetermined determination condition is satisfied, for example, when the first electrode 313 and the second electrode 314 of the core 310 are located on the upper side and when disposition of the first electrode 313 and the second electrode 314 becomes predetermined disposition. For example, the sorter 45 is configured to include a pump mechanism capable of ejecting compressed air. The sorter 45 ejects the compressed air to a sorting area on a downstream side of the determination position in a conveyance direction of the core 310 on the straight advancing conveyer 42B. Consequently, the core 310 that is determined not to be disposed in the predetermined direction by the determination unit 44 is blown off and returned to the reserve unit 41.

The core supply device 40 also includes a separation conveyer 46. The separation conveyer 46 includes a carrier 47 disposed close to the other end of the straight advancing conveyer 42B, a linear rail 49 that supports the carrier 47, and an actuator 50 that moves the carrier 47 relative to the rail 49. For example, the actuator 50 is a feed screw mechanism, and includes a screw 51 extending along a longitudinal direction of the rail 49 and a motor 52 that rotates the screw 51. The screw 51 is connected to the carrier 47. In the actuator 50, the motor 52 rotates the screw 51 clockwise or counterclockwise, thereby moving the carrier 47 in an axial direction of the screw 51, namely, in the longitudinal direction of the rail 49. A plurality of accommodation recesses 48 are provided in the carrier 47. Each accommodation recess 48 is constituted with a square bottom face 48A and a side face 48B vertically provided from the peripheral edge of the bottom face 48A.

In each accommodation recess 48, the side face 48B is not vertically provided on the side of the straight advancing conveyer 42B, and the end and the upper end on the side of the straight advancing conveyer 42B are opened. A volume of the accommodation recess 48 is designed to an extent in which one core 310 is accommodated. A suction hole is formed in the side face 48B of each accommodation recess 48, and it is possible to suck the core 310 from the outside toward the inside of the accommodation recess 48. The core 310 conveyed by the straight advancing conveyer 42B is separately accommodated in each accommodation recess 48 of the carrier 47.

A drive mode of the core supply device 40 will be described.

In a state in which the core 310 is supplied from the reserve unit 41 to the feeder 42, the control device 260 drives the vibrator 43 to vibrate the circumferential-direction conveyer 42A and the straight advancing conveyer 42B. Consequently, the core 310 moves over the circumferential-direction conveyer 42A and the straight advancing conveyer 42B, and conveyed from the circumferential-direction conveyer 42A toward the other end of the straight advancing conveyer 42B. When the core 310 moves over the straight advancing conveyer 42B, the determination unit 44 sequentially inputs information about whether each conveyed cores 310 is disposed in the predetermined direction to the control device 260. The control device 260 drives the sorter 45 based on the information. That is, the control device 260 drives the sorter 45 to return the core 310 to the reserve unit 41 when the core 310 that is not disposed in the predetermined direction is conveyed to the sorting area on the straight advancing conveyer 42B. Consequently, only the core 310 disposed in the predetermined direction is conveyed to the other end of the straight advancing conveyer 42B. At the other end of the straight advancing conveyer 42B, the accommodation recesses 48 of the carrier 47 are disposed so as to face each other. The core 310 conveyed to the other end of the straight advancing conveyer 42B is accommodated in the accommodation recess 48 by the suction from the suction hole of the carrier 47.

When the core 310 is accommodated in the accommodation recess 48, the control device 260 stops the driving of the vibrator 43, and drives the motor 52 to slightly move the carrier 47. Consequently, the accommodation recess 48 of the carrier 47 in a vacant state, in which the core 310 is not accommodated yet, is faced to the other end of the straight advancing conveyer 42B. Then, the control device 260 drives the vibrator 43 again to convey the core 310 to the other end of the straight advancing conveyer 42B, and moves the core 310 to the accommodation recess 48 by the suction from the suction hole of the carrier 47. The control device 260 accommodates the cores 310 in all the plurality of storage recesses 48 of the carrier 47 by repeating such processing. Then, the control device 260 drives the motor 52 to deliver the carrier 47 to the core input device 55. Consequently, the carrier 47 is moved from a first position corresponding to the straight advancing conveyer 42B to a second position corresponding to the core input device 55.

(Core Input Device)

The configuration of the core input device 55 is similar to that of a known device that inputs the core 310 accommodated in the carrier 47 to another device. The outline of the core supply device 40 will be described below.

As illustrated in FIG. 3, the core input device 55 includes a drive unit 56 and a plurality of suction nozzles 57 connected to the drive unit 56. The drive unit 56 includes a known mechanism capable of three-dimensionally moving the suction nozzle 57. The number of the suction nozzles 57 is the same as the number of the accommodation recesses 48 of the carrier 47. The suction nozzle 57 includes a suction hole (not illustrated) at a lower end, and performs the suction hole from the suction hole to suck the core 310 to the lower end. The core input device 55 takes out the core 310 conveyed by the carrier 47, and inputs the core 310 to the wire winding device 60. A grasping unit 90 (to be described later) is provided in the wire winding device 60, and the core input device 55 inputs the core 310 to the wire winding device 60 by causing the grasping unit 90 to grasp the core 310 sucked by the suction nozzle 57.

The drive mode of the core input device 55 will be described with reference to FIG. 6. An operation mode is common to the plurality of suction nozzles 57, and thus one suction nozzle 57 will be described below as an example.

Figure 6A:
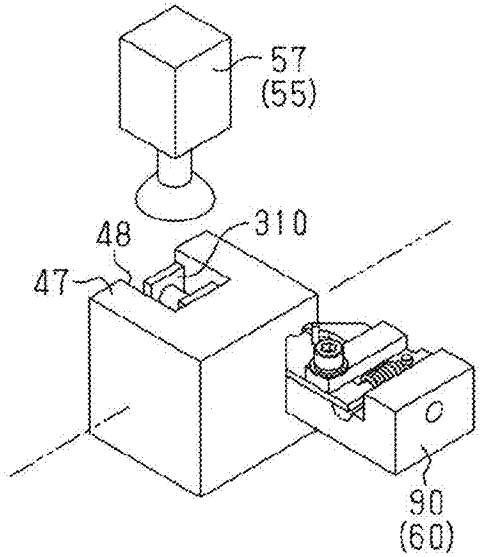
FIGS. 6A to 6F are perspective views schematically illustrating an operation mode of a core input device.
Figure 6B:
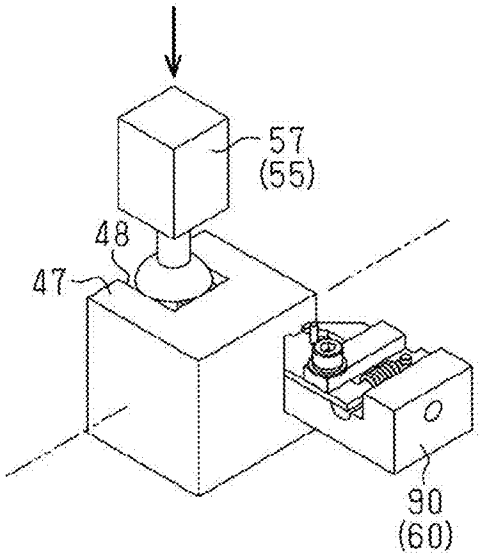
Figure 6C:
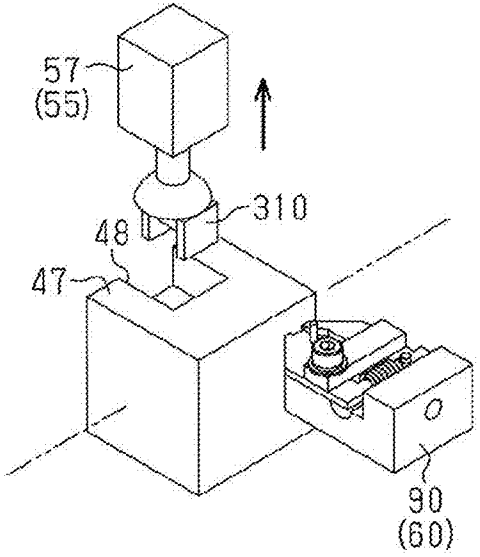
Figure 6D:
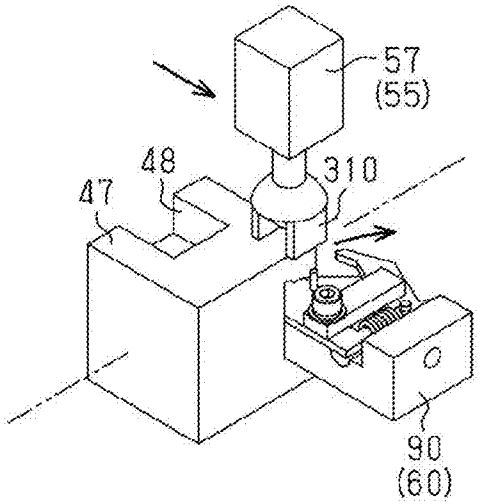
Figure 6E:
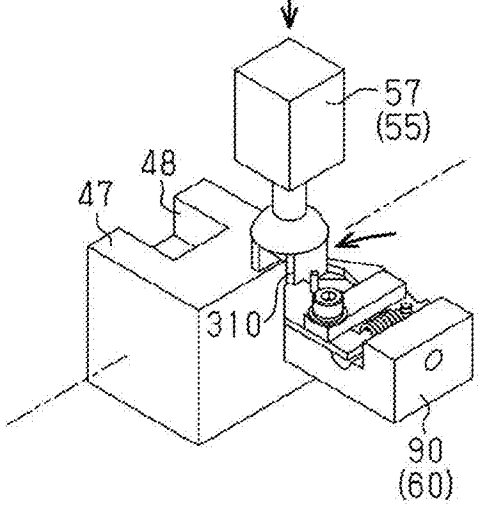
Figure 6F:
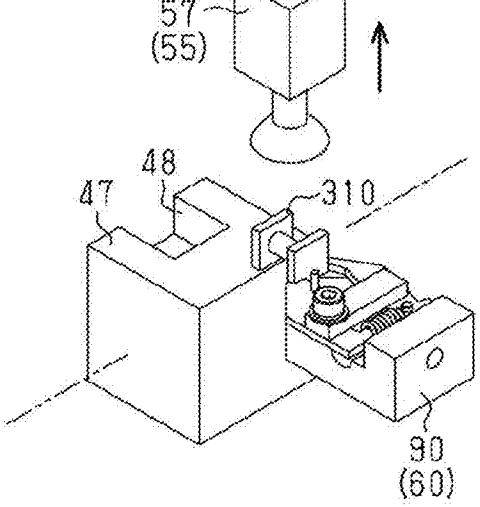

As illustrated in FIG. 6A, when the carrier 47 is moved to the second position, the control device 260 drives the core input device 55. When the core input device 55 is driven, the drive unit 56 lowers the suction nozzle 57. As illustrated in FIG. 6B, when the lower end of the suction nozzle 57 abuts on the core 310, the suction nozzle 57 starts the suction from the suction hole, and sucks the core 310 to the lower end. Then, as illustrated in FIG. 6C, the drive unit 56 raises the suction nozzle 57 and takes out the core 310 from the carrier 47. Then, as illustrated in FIG. 6D, the drive unit 56 moves the suction nozzle 57 onto the side of the grasping unit 90 of the wire winding device 60. At this point, the grasping unit 90 of the wire winding device 60 is opened to become the state in which the core 310 can be placed. Then, as illustrated in FIG. 6E, the drive unit 56 lowers the suction nozzle 57 to place the core 310 on the grasping unit 90, and the grasping unit 90 of the wire winding device 60 is closed, whereby the grasping unit 90 grasps the core 310 while nipping the core 310. As illustrated in FIG. 6F, when the grasping unit 90 grasps the core 310, the suction nozzle 57 stops the suction and releases the sticking of the core 310, and the drive unit 56 raises the suction nozzle 57. Then, the drive unit 56 moves the suction nozzle 57 such that the suction nozzle 57 is disposed at an original initial position illustrated in FIG. 6A. The core input device 55 inputs the core 310 supplied from the core supply device 40 to the wire winding device 60 by repeating a series of operations.

(Wire Winding Device)

As illustrated in FIG. 3, the wire winding device 60 includes a support post 61 extending upward from the base 20. As illustrated in FIG. 4, one end of the support post 61 is fixed to the upper surface of the base 20, and the support post 61 extends upward while being inserted in the through-hole 33 made in the direct drive motor 31 and the index table 32. The support post 61 is separated from the direct drive motor 31 and the index table 32 so as not to prevent the rotation of the index table 32.

As illustrated in FIG. 3, a holding plate 62 is fixed to the supporting post 61 above the rotating device 30. The holding plate 62 is formed into a flat plate shape extending in parallel to the upper surface of the base 20. The holding plate 62 holds a plurality of wire bobbins 63 placed on the upper surface of the holding plate 62. Twelve wire bobbins 63 are provided in the embodiment. One wire 320 is wound around each wire bobbin 63. The wire bobbin 63 functions as a wire supply source.

A tensioner 64 is connected to the upper end of the support post 61. The tensioner 64 includes a housing 65 having a square box shape. A plurality of slits 65A are formed in the housing 65 so as to extend from the front side wall to the upper wall thereof. Twelve slits 65A are formed in the crosswise direction.

Figure 7:
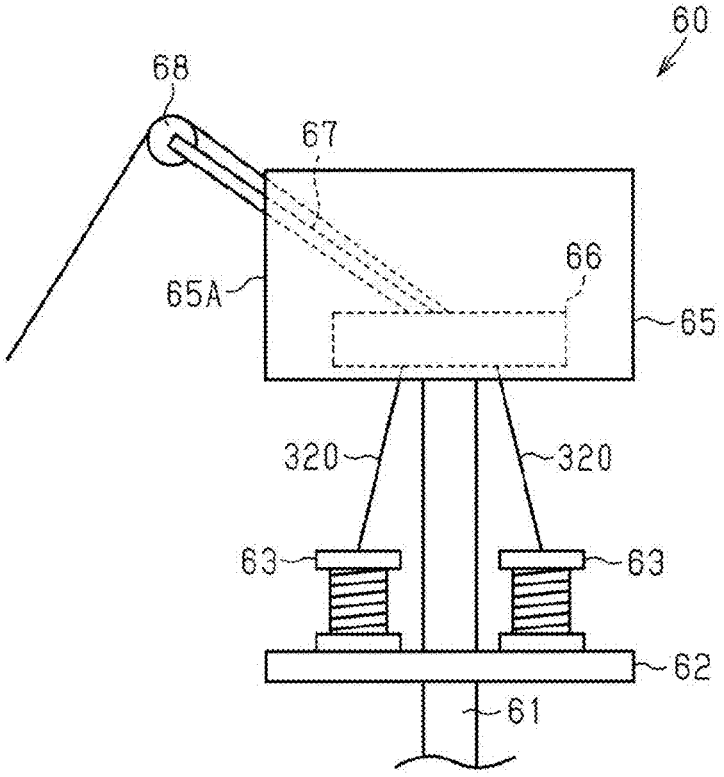
FIG. 7 is a side view schematically illustrating configurations of a holding plate, a wire bobbin, and a tensioner of a wire winding device.

As illustrated in FIG. 7, a tension controller 66 is provided in the housing 65. A base end of a tension arm 67 is connected to the tension controller 66. A plurality of tension arms 67 are provided, and each tension arm 67 extends to the outside of the housing 65 through the slit 65A of the housing 65. A pulley 68 is connected to a leading end of each tension arm 67. Each wire 320 pulled out from the wire bobbin 63 is passed through the tension controller 66, and wound around the individual pulley 68. The tension controller 66 has a brake function of controlling tension of the wire 320 such that the wire 320 pulled out from the wire bobbin 63 has a predetermined tension by a hysteresis brake (not illustrated). The tension controller 66 also has a wire feeding function of feeding the wire 320 from the wire bobbin 63 to a nozzle 75 by a wire feeding mechanism (not illustrated).

As illustrated in FIG. 3, a plurality of nozzle moving devices 69 of the wire winding device 60 are arranged in the crosswise direction. In the embodiment, six nozzle moving devices 69 are provided, and the nozzle 75 is provided in each of the nozzle moving devices 69. That is, the wire winding device 60 includes six nozzles 75. Two of the wires 320 pulled out from the twelve wire bobbins 63 are supplied to one nozzle 75.

Figure 8:
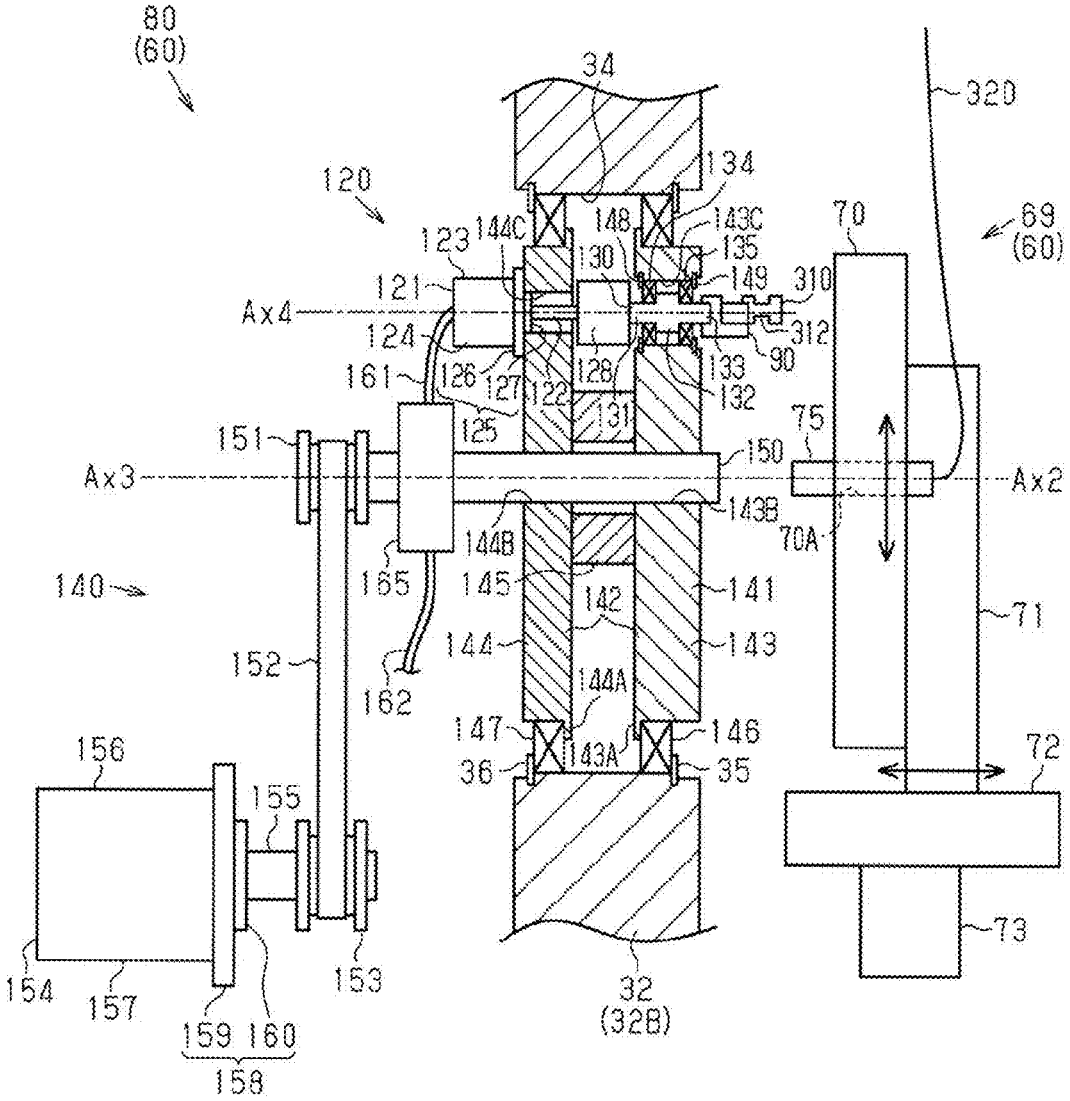
FIG. 8 is a sectional view illustrating a schematic configuration of a core moving device of the wire winding device.

As illustrated in FIG. 8, the nozzle moving device 69 includes a holding body 70 that includes a holding hole 70A to hold the nozzle 75 inserted in the holding hole 70A and a first moving body 71 that vertically moves the holding body 70. The nozzle moving device 69 also includes a second moving body 72 that moves the first moving body 71 in a front-rear direction (the crosswise direction in FIG. 8) and a third moving body 73 that moves a second moving body 72 in the crosswise direction (the depth direction in FIG. 8).

Figure 9A:
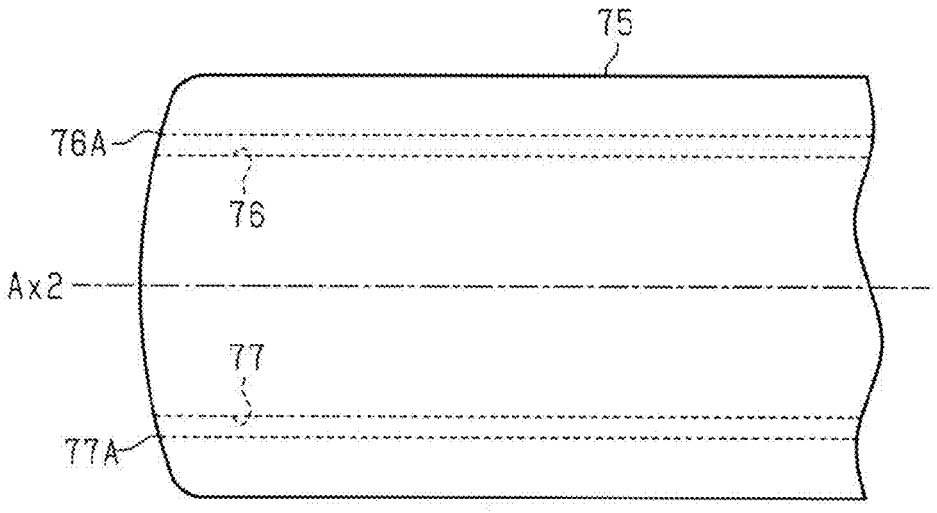
FIG. 9A is a plan view illustrating a leading end of a nozzle.
Figure 9B:
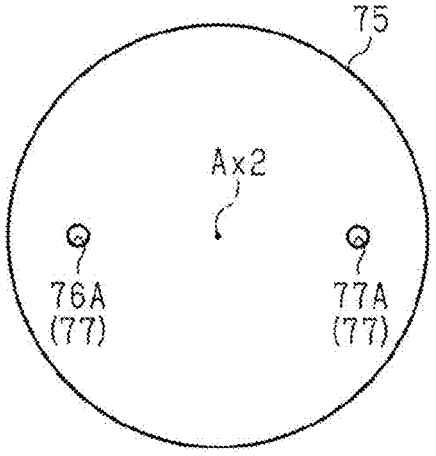
FIG. 9B is a front view of the nozzle.

As illustrated in FIGS. 9A and 9B, the nozzle 75 is formed into a columnar shape. As illustrated in FIG. 9A, a first wire passage hole 76 and a second wire passage hole 77, which extend in an extending direction of the central axial line Ax2 (the crosswise direction in FIG. 9A), are provided in the nozzle 75. The first wire passage hole 76 and the second wire passage hole 77 extend from one end to the other end in the extending direction of the nozzle 75. One end face of the nozzle 75 (the left end face in FIG. 9A) is formed into a spherical shape protruding forward toward the center side. As illustrated in FIG. 9B, the first wire passage hole 76 and the second wire passage hole 77 are symmetrically disposed with respect to the central axial line Ax2. Consequently, the central portion between the first wire passage hole 76 and the second wire passage hole 77 at one end face of the nozzle 75 is swelled forward from a portion in which an opening 76A of the first wire passage hole 76 and an opening 77A of the second wire passage hole 77 are provided. The other end face of the nozzle 75 on the opposite side to one end face may have a spherical shape protruding forward toward the center side similarly to one end face or a spherical shape recessed toward the center side. The other end face of the nozzle 75 may have a planar shape.

As illustrated in FIG. 8, the wire 320 is inserted in the nozzle 75 from the side of the other end face (the right end face in FIG. 8) toward the side of one end face (the left end face in FIG. 8). One of the two wires 320 supplied to the nozzle 75 is supplied to the first wire passage hole 76 and the other is supplied to the second wire passage hole 77. The wire 320 supplied to the first wire passage hole 76 is the first wire 321 and the wire 320 supplied to the second wire passage hole 77 is the second wire 322.

The wire winding device 60 includes a plurality of core moving devices 80, which face the one end face of the nozzle 75 and disposed separately from the nozzle moving device 69 by a predetermined distance. Each of the core moving devices 80 includes the grasping unit 90 that grasps the core 310, a rotation drive unit 120 that rotates the grasping unit 90 about the central axial line Ax4 of a rotation shaft 130, and a revolution drive unit 140 that revolves both the grasping unit 90 and the rotation drive unit 120 about a central axial line Ax3 of a revolution shaft 150. One core moving device 80 will be described below as an example.

The revolution drive unit 140 includes a rotating body 141. The rotating body 141 is disposed in an inner region of the cylindrical hole 34 provided in the side wall 32B of the index table 32. The rotating body 141 is constituted with a pair of rotating supports 142 formed in a columnar shape and a connecting shaft 145 connecting the pair of rotating supports 142. In the pair of rotating supports 142, the rotating support 142 disposed on the side closer to the nozzle moving device 69, namely, the side (the right side in FIG. 8) of an outer surface of the index table 32 is referred to as a first rotating support 143, and the rotating support 142 disposed on the side farther away from the nozzle moving device 69, namely, the side (the left side in FIG. 8) of an inner surface of the index table 32 is referred to as a second rotating support 144.

Outer diameters of the first rotating support 143 and the second rotating support 144 are smaller than an inner diameter of the cylindrical hole 34. In the outer surface of the first rotating support 143, a first flange 143A protruding outward in a radial direction is formed at the end on the side of the second rotating support 144. In the outer surface of the second rotating support 144, a second flange 144A protruding outward in the radial direction is formed at the end on the side of the first rotating support 143. A first through-hole 143B is formed in the center of the first rotating support 143. In the first rotating support 143, a third through-hole 143C is formed at a position eccentric from the first through-hole 143B. A second through-hole 144B is formed in the center of the second rotating support 144. The central axis of the first through-hole 143B is disposed coaxially with a central axis of the second through-hole 144B. In the second rotating support 144, a fourth through-hole 144C is formed at a position eccentric from the second through-hole 144B. The central axis of the third through-hole 143C is disposed coaxially with the central axis of the fourth through-hole 144C.

In the side wall 32B of the index table 32, an annular first regulating unit 35 and an annular second regulating unit 36 are provided in the circumferential surface constituting the cylindrical hole 34 while separated from each other in the central axis direction. The first regulating unit 35 is disposed on the side (the right side in FIG. 8) of the outer surface with respect to the first flange 143A, and the second regulating unit 36 is disposed on the side (the left side in FIG. 8) of the inner surface with respect to the second flange 144A. A first bearing 146 is sandwiched between the first flange 143A and the first regulating unit 35. The first bearing 146 is disposed between the first rotating support 143 and the side wall 32B of the index table 32 in the radial direction of the first rotating support 143. The first rotating support 143 is supported by the first bearing 146 so as to be rotatable relative to the side wall 32B of the index table 32. A second bearing 147 is sandwiched between the second flange 144A and the second regulating unit 36. The second bearing 147 is disposed between the second rotating support 144 and the side wall 32B of the index table 32 in the radial direction of the second rotating support 144. The second rotating support 144 is supported by the second bearing 147 so as to be rotatable relative to the side wall 32B of the index table 32.

The connecting shaft 145 is formed into a cylindrical shape extending in the central axis direction of the first through-hole 143B and the second through-hole 144B. One end face of the connecting shaft 145 is connected to the first rotating support 143, and the other end face is connected to the second rotating support 144. The inner diameter of the connecting shaft 145 is larger than the diameters of the first through-hole 143B and the second through-hole 144B. The outer diameter of the connecting shaft 145 is smaller than the outer diameter of the pair of rotating supports 142. The central axis of the connecting shaft 145 is disposed coaxially with the central axis of the first through-hole 143B and the second through-hole 144B.

One end portion of the revolution shaft 150 is inserted in the first through-hole 143B of the first rotation support 143, the connecting shaft 145, and the second through-hole 144B of the second rotating support 144. One end portion of the revolution shaft 150 is connected to the first rotating support 143 and the second rotating support 144, and the rotating body 141 rotates when the revolution shaft 150 rotates. The central axial line Ax3 of the revolution shaft 150 is disposed coaxially with the central axial line of the cylindrical hole 34. In the state of FIG. 8, the central axial line Ax3 of the revolution shaft 150 is disposed coaxially with the central axial line Ax2 of the nozzle 75.

The revolution shaft 150 extends inside the index table 32. A driven-side pulley 151 is connected to the other end of the revolution shaft 150. A rotating belt 152 is wound around the driven-side pulley 151. The rotating belt 152 is also wound around a driving-side pulley 153.

A rotating shaft 155 of a revolution motor 154 is connected to the driving-side pulley 153. The revolution motor 154 includes a main body 156 in which the rotating shaft 155 is inserted. The main body 156 includes a cylindrical unit 157 that rotates the rotating shaft 155 and a lid 158 closing one end of the cylindrical unit 157. The lid 158 is formed into a disc shape, and includes an enlarged diameter unit 159 the diameter of which is larger than that of the cylindrical unit 157 and a reduced diameter unit 160 connected to the enlarged diameter unit 159. The diameter of the reduced diameter unit 160 is smaller than that of the cylindrical unit 157. The rotating shaft 155 penetrates the lid 158 to extend to the inside of the cylindrical unit 157. A support mechanism (not illustrated) provided in the index table 32 is connected to the main body 156 of the revolution motor 154. The support mechanism supporting the revolution motor 154 is fixed to the index table 32.

The rotation drive unit 120 includes a rotation motor 121 connected to the second rotating support 144. The rotation motor 121 includes a rotating shaft 122 and a main body 123 in which the rotating shaft 122 is inserted. The main body 123 includes a cylindrical unit 124 that rotates the rotating shaft 122 and a lid 125 closing one end of the cylindrical unit 124. The lid 125 is formed into a disc shape, and includes an enlarged diameter unit 126 the diameter of which is larger than that of the cylindrical unit 124 and a reduced diameter unit 127 connected to the enlarged diameter unit 126. The diameter of the reduced diameter unit 127 is smaller than that of the cylindrical unit 124.

The outer diameter of the reduced diameter unit 127 is equal to the diameter of the fourth through-hole 144C of the second rotating support 144. The rotating shaft 122 penetrates the lid 125 to extend to the inside of the cylindrical unit 124. The reduced diameter unit 127 of the rotation motor 121 is inserted in the fourth through-hole 144C from the inside of the index table 32, and the enlarged diameter unit 126 is connected to the second rotating support 144 in this state. The rotating shaft 122 of the rotation motor 121 extends through the fourth through-hole 144C. A coupling 128 is assembled to the leading end of the rotating shaft 122. The coupling 128 is disposed between the first rotating support 143 and the second rotating support 144 in the axial direction (the crosswise direction in FIG. 8) of the rotating shaft 122. One end of the rotation shaft 130 is assembled to the coupling 128. The coupling 128 connects the rotating shaft 122 and the rotation shaft 130, and prevents the misalignment between the rotating shaft 122 and the rotation shaft 130.

The rotation shaft 130 is inserted in the third through-hole 143C of the first rotating support 143, and extends through the first rotating support 143. The rotation shaft 130 includes a first shaft 131 connected to the coupling 128 and a second shaft 132, which is connected to the first shaft 131 and has a larger diameter than the first shaft 131. The second shaft 132 is disposed in the inner region of the third through-hole 143C. The rotation shaft 130 also includes a third shaft 133, which is connected to the second shaft 132 and has the same diameter as the first shaft 131. The third shaft 133 extends toward the side of the nozzle moving device 69 from the first rotating support 143. In the first rotating support 143, an annular third regulating unit 148 and an annular fourth regulating unit 149 are provided in the third through-hole 143C while separated from each other in the direction of the central axial line Ax4 of the rotation shaft 130. The third regulating unit 148 is located in the inner region side of the index table 32 compared with the fourth regulating unit 149. The second shaft 132 is disposed between the third regulating unit 148 and the fourth regulating unit 149 in the direction of the central axial line Ax4 of the rotation shaft 130.

A third bearing 134 is sandwiched between the first shaft 131 and the first rotating support 143 in the radial direction of the rotation shaft 130. The third bearing 134 is sandwiched between the third regulating unit 148 and the second shaft 132 in the direction of the central axial line Ax4 of the rotation shaft 130. The first shaft 131 is supported by the third bearing 134 so as to be rotatable relative to the first rotating support 143. A fourth bearing 135 is sandwiched between the third shaft 133 and the first rotating support 143 in the radial direction of the rotation shaft 130. The fourth bearing 135 is sandwiched between the fourth regulating unit 149 and the second shaft 132 in the direction of the central axial line Ax4 of the rotation shaft 130. The third shaft 133 is supported by the fourth bearing 135 so as to be rotatable relative to the first rotating support 143. The grasping unit 90 is connected to the third shaft 133 of the rotation shaft 130.

One end of a first electric wire 161 is connected to the rotation motor 121 in order to drive the rotation motor 121. The first electric wire 161 is constituted with a plurality of conductive core wires and an insulating coating material covering the core wire. The other end of the first electric wire 161 is connected to a slip ring mechanism 165. The slip ring mechanism 165 is connected to an intermediate portion between both the ends of the revolution shaft 150, and disposed between the second rotating support 144 and the driven-side pulley 151. One end of a second electric wire 162 is connected to the slip ring mechanism 165.

The other end of the second electric wire 162 is connected to a power supply (not illustrated). The electric power supplied from the power supply is supplied to the rotation motor 121 through the second electric wire 162, the slip ring mechanism 165, and the first electric wire 161. The electric power is supplied to the rotation motor 121, thereby rotating the rotation shaft 130. The slip ring mechanism 165 is a known mechanism that ensures the supply of the electric power to the rotation motor 121 while preventing the first electric wire 161 and the second electric wire 162 from twining around the revolution shaft 150 when the revolution shaft 150 is rotating.

As illustrated in FIG. 3, the grasping unit 90 is disposed outside the side walls 32B of the index table 32. In the embodiment, six grasping units 90 are arranged on each side wall 32B. The grasping units 90 have the same configuration. The grasping unit 90 is configured to be able to grasp the core 310, and grasps the core 310 input from the core input device 55 as described above. Although not illustrated, the wire winding device 60 also includes, in the vicinity of the grasping unit 90, a starting wire grasping body that grasps the end on a winding starting side of the wire 320, a wire passage support that hooks the end on a winding ending side of the wire 320, and an ending wire grasping body that grasps the end on the winding end side of the wire 320.

In the wire winding device 60, the core moving device 80 and the grasping unit 90 are connected to the index table 32, and configured to be rotatable together with the index table 32 with the support post 61 as a rotating center. Consequently, the positions of the core moving device 80 and the grasping unit 90 change in association with the rotation of the index table 32.

A drive mode of the wire winding device 60 will be described.

When the grasping unit 90 to which the core 310 is input by the core input device 55 is disposed so as to face the nozzle moving device 69 in association with the rotation of the index table 32, the control device 260 drives the nozzle moving device 69 while controlling the tension controller 66 to deliver the wire 320 from the wire bobbin 63 to the nozzle 75, thereby moving the nozzle 75. The end on the winding starting side is grasped by the starting wire grasping body while the end on the winding starting side of the wire 320 protrudes from the one end face of the nozzle 75. In this point, the control device 260 drives the nozzle moving device 69 to move the nozzle 75, thereby routing the wire 320 on the electrodes 313, 314 of the first flange 311A of the core 310.

Then, the control device 260 drives the revolution drive unit 140 and the rotation drive unit 120, and rotates the core 310 about the central axial line Ax4 of the rotation shaft 130 while revolving the core 310 around the nozzle 75 with the center axial line Ax3 of the revolution shaft 150 as a rotating center. Consequently, the wire 320 is wound around the winding core 312 of the core 310. When the wire 320 is wound around the core 310, the control device 260 drives the nozzle moving device 69 to move the nozzle 75, and hooks the end on the winding ending side of the wire 320 on the wire passage support, whereby the wire 320 is routed on the electrodes 313, 314 of the second flange 311B of the core 310. In this point, the control device 260 causes an ending line grasping body 205 to grasp the end on the winding ending side of the wire 320.

(Wire Bonding Device)

The configuration of the wire bonding device 240 is similar to that of a known device that cuts the excessive wire 320 while bonding the wire 320 wound around the core 310 to the core 310.

The outline of the core supply device 40 will be described below.

Figure 10A:
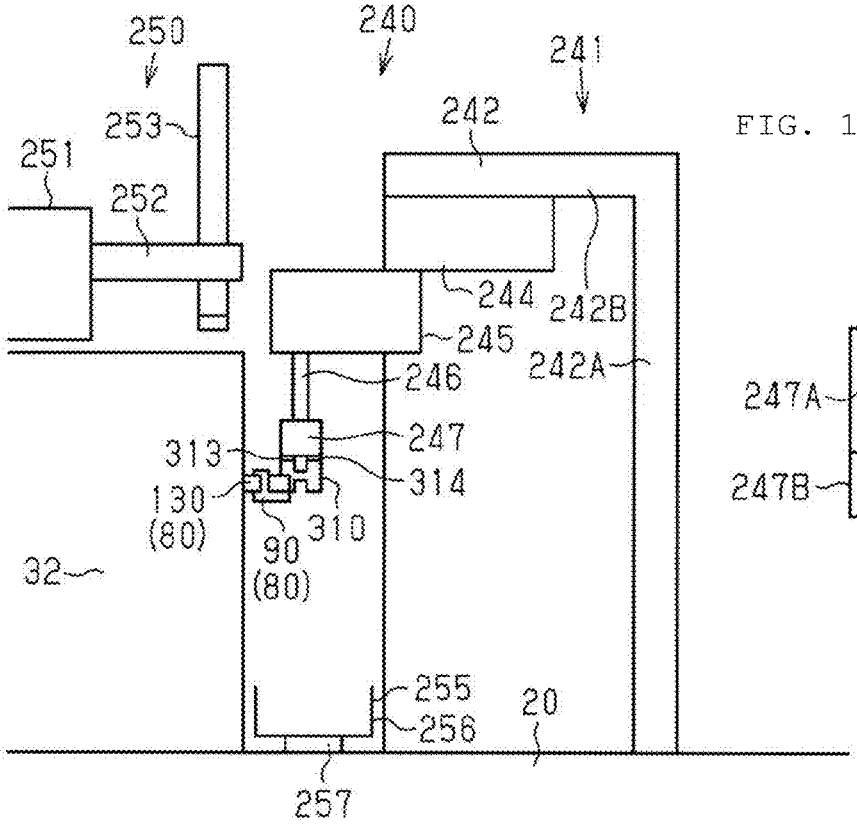
FIG. 10A is a side view illustrating a schematic configuration of a wire bonding device.

As illustrated in FIG. 10A, the wire bonding device 240 includes a wire bonder 241 and a wire cutter 250. The wire bonder 241 includes a support base 242. As illustrated in FIG. 3, the support base 242 is formed into a square box shape, and includes a side wall 242A vertically provided from the base 20 and an upper wall 242B connecting the upper end of the side wall 242A. One end of an electric cable 243 is connected to the side wall 242A. The electric cable 243 extends toward the inside of the base 20, and the other end of the electric cable 243 is connected to the control device 260.

As illustrated in FIG. 10A, in the support base 242, the side wall 242A is not vertically provided on one end side of the index table 32, and the end side is opened. A support 244 connected to the upper wall 242B of the support base 242 and a moving unit 245 connected to the support 244 are provided in the support base 242. The support 244 moves a moving unit 245 in a direction in which the moving unit 245 approaches and separates from the index table 32 (the crosswise direction in FIG. 10). A first pressing unit 246 is connected to the moving unit 245. The upper end of the first pressing unit 246 is inserted in the moving unit 245. The moving unit 245 moves the first pressing unit 246 in the vertical direction. A second pressing unit 247 is connected to the lower end of the first pressing unit 246. The plurality of supports 244, moving units 245, first pressing units 246, and second pressing units 247 are provided as many as the holding unit 90 provided on one side face of the index table 32.

Figure 10B:
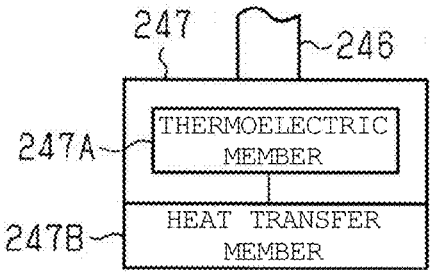
FIG. 10B is a schematic diagram illustrating a configuration of a second pressing unit.

As illustrated in FIG. 10B, the second pressing unit 247 includes a thermoelectric member 247A and a heat transfer member 247B. For example, the second pressing unit 247 is a pulse heater. For example, the thermoelectric member 247A is a thermocouple, and the heat transfer member 247B is a heater chip. The thermoelectric member 247A is configured to be able to generate heat by receiving an electric signal from the electric cable 243. A material, such as molybdenum, titanium, and stainless steel, which has good thermal conductivity, is used as the heater chip. The heat transfer member 247B constitutes the lower end of the second pressing unit 247.

In the wire bonder 241, the support 244 moves the moving unit 245 onto the side of the index table 32, and the moving portion 245 moves the first pressing unit 246 downward while the second pressing unit 247 is disposed above the core 310, whereby the second pressing unit 247 comes into contact with the core 310 and is pressed against the core 310 as illustrated in FIG. 10A. The core 310 is grasped by the grasping unit 90 such that the electrodes 313, 314 are located in the upper portion. At this point, when the thermoelectric member 247A of the second pressing unit 247 generates heat, the heat is transferred to the electrodes 313, 314 of the core 310 through the heat transfer member 247B.

Figure 11:
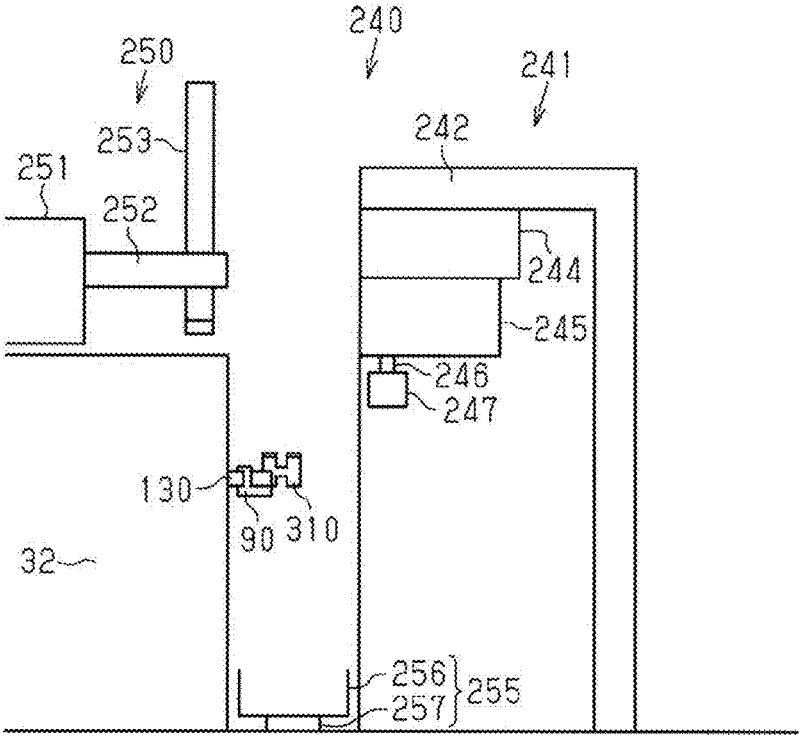
FIG. 11 is a side view illustrating an accommodation state of a wire bonding unit in the wire bonding device.

In the wire bonder 241, the support 244 moves the moving unit 245 onto the side (the right side in FIG. 10) where the moving unit 245 separates from the index table 32, so that the moving unit 245 is accommodated in the support base 242. As illustrated in FIG. 11, in the accommodation state, the moving unit 245 moves the first pressing unit 246 upward, and the second pressing portion 247 is disposed in the upper portion.

As illustrated in FIG. 10A, the wire cutter 250 includes a fixing base 251 disposed above the index table 32. The fixing table 251 is disposed separately from the index table 32. As illustrated in FIG. 3, the fixing base 251 is fixed to the supporting post 61, and configured not to rotate in association with the rotation of the index table 32.

Figure 12A:
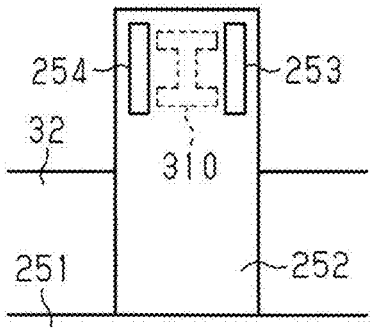
FIG. 12A is a plan view illustrating a configuration of a wire cutting unit of a wire bonding device.
Figure 12B:
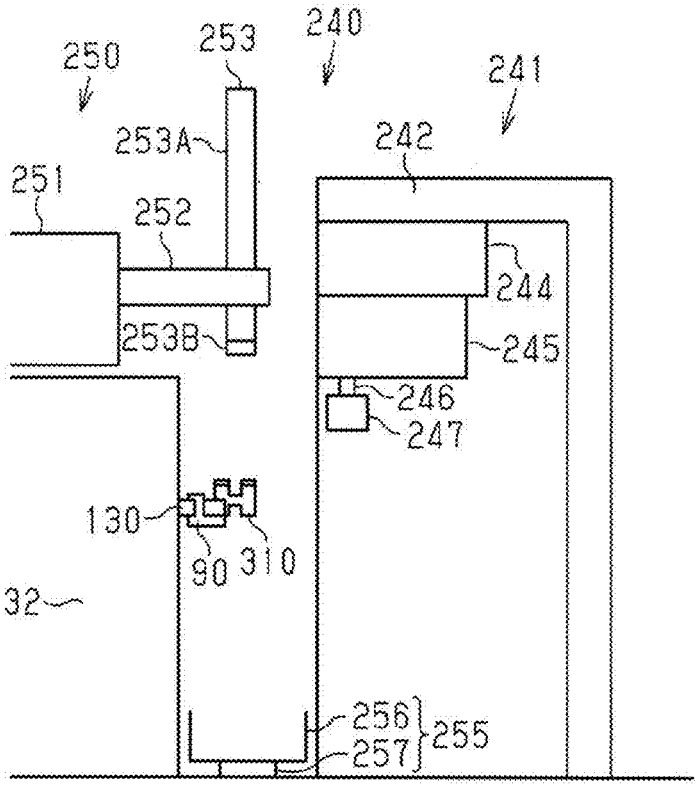
FIG. 12B is a side view illustrating a configuration of the wire cutting unit.

As illustrated in FIG. 12A, a protrusion 252 is connected to the fixing base 251 so as to be able to protrude from the side face of the protrusion 252. A plurality of protrusions 252 are disposed as many as the core 310 input to one side face of the index table 32 in one process. The protrusion 252 is configured to be able to protrude to a position covering the upper portion of the core 310. A first wire cutting unit 253 and a second wire cutting unit 254 are provided at the leading end of the protrusion 252. The first wire cutting unit 253 and the second wire cutting unit 254 are disposed separately from each other in a direction (the crosswise direction in FIG. 12A) orthogonal to the protruding direction of the protrusion 252 (the vertical direction in FIG. 12A). In the orthogonal direction, the core 310 grasped by the grasping unit 90 is disposed between the first wire cutting unit 253 and the second wire cutting unit 254. As illustrated in FIG. 12B, the first wire cutting unit 253 includes a moving unit 253A provided so as to be vertically movable relative to the fixed base 251 and a cutting blade 253B connected to the lower end of the moving unit 253A. The second wire cutting unit 254 has the same configuration as the first wire cutting unit 253.

The wire cutter 250 also includes a waste line recovery unit 255. The waste line recovery unit 255 includes a recovery box 256 disposed below the core 310 grasped by the grasping unit 90 and a suction fan 257 connected to the bottom wall of the recovery box 256. The recovery box 256 is formed into a box shape the top of which is opened. The recovery box 256 recovers the cut excessive wire 320. The suction fan 257 is fixed to the upper surface of the base 20 and forms an air flow from above the recovery box 256 toward the inside of the recovery box 256, so that the excessive wire 320 is easily recovered in the recovery box 256.

The drive mode of the wire bonding device 240 will be described.

When the core 310 around which the wire 320 is wound by the wire winding device 60 is disposed on the side of the wire bonding device 240 in association with the rotation of the index table 32, the control device 260 drives the support 244 and the moving unit 245 of the wire bonding portion 241 to bring the second pressing unit 247 and the core 310 into contact with each other as illustrated in FIG. 10A. In this point, the control device 260 causes the thermoelectric member 247A of the second pressing unit 247 to generate heat. Consequently, the first wire 321 is bonded to the first electrode 313 of the core 310, and the second wire 322 is bonded to the second electrode 314. As a result, the first wire 321 and the first electrode 313 are electrically connected to each other, and the second wire 322 and the second electrode 314 are electrically connected to each other.

Figure 13:
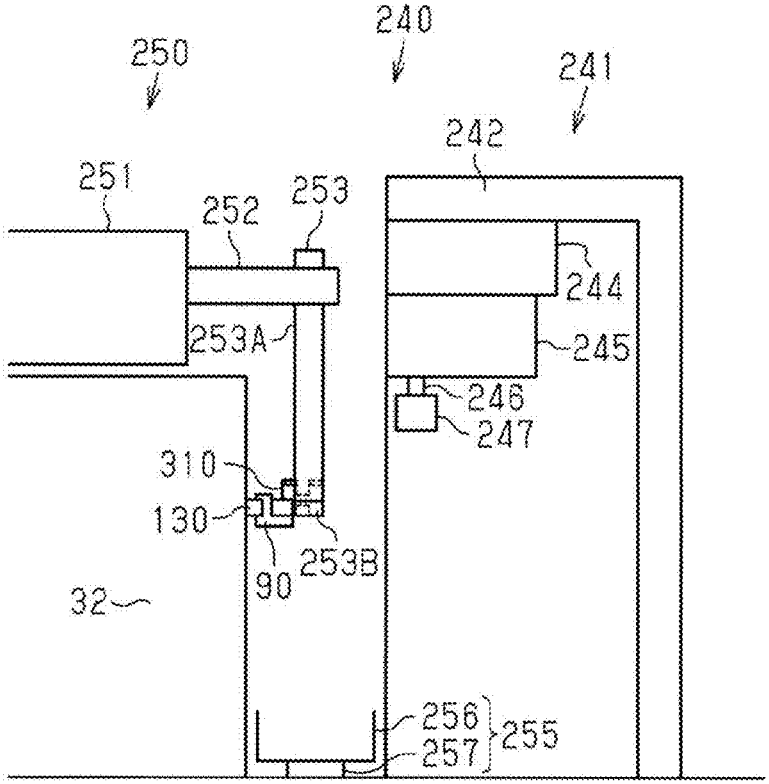
FIG. 13 is a side view illustrating a wire cut state in the wire cutting unit.

After the wire 320 is bonded to the core 310, the control device 260 drives the support 244 and the moving unit 245 to accommodate the moving unit 245, the first pressing unit 246, and the second pressing unit 247 in the support base 242 as illustrated in FIG. 11. Then, as illustrated in FIG. 12, the control device 260 drives the protrusion 252 of the wire cutter 250 to dispose the first wire cutting unit 253 and the second wire cutting unit 254 above the core 310. The control device 260 drives the moving units 253A of the first wire cutting unit 253 and the second wire cutting unit 254 to move the cutting blades 253B downward. As illustrated in FIG. 13, the cutting blades 253B are lowered to positions below electrodes 313, 314 of the core 310. Consequently, the excessive wire 320 of the first wire 321 and the second wire 322 is cut, and the coil component 300 in which the first wire 321 and the second wire 322 are wound around the core 310 is manufactured. In this point, the end on the winding starting side of the wire 320 is cut off from the coil component 300 and grasped by the starting wire grasping body. The end on the winding ending side of the wire 320 is cut off from the coil component 300 and grasped by the ending line grasping body.

Then, the control device 260 releases the grasp of the wire 320 by the starting line grasping body, and releases the grasp of the wire 320 by the ending line gripping body. According to this, the control device 260 drives the suction fan 257. Consequently, the excessive wire 320 grasped by the starting line grasping body is recovered in the recovery box 256. The wire 320 grasped by the ending line grasping body is not cut off from the nozzle 75, but protrudes from one end face of the nozzle 75.

(Control Device)

Figure 14:
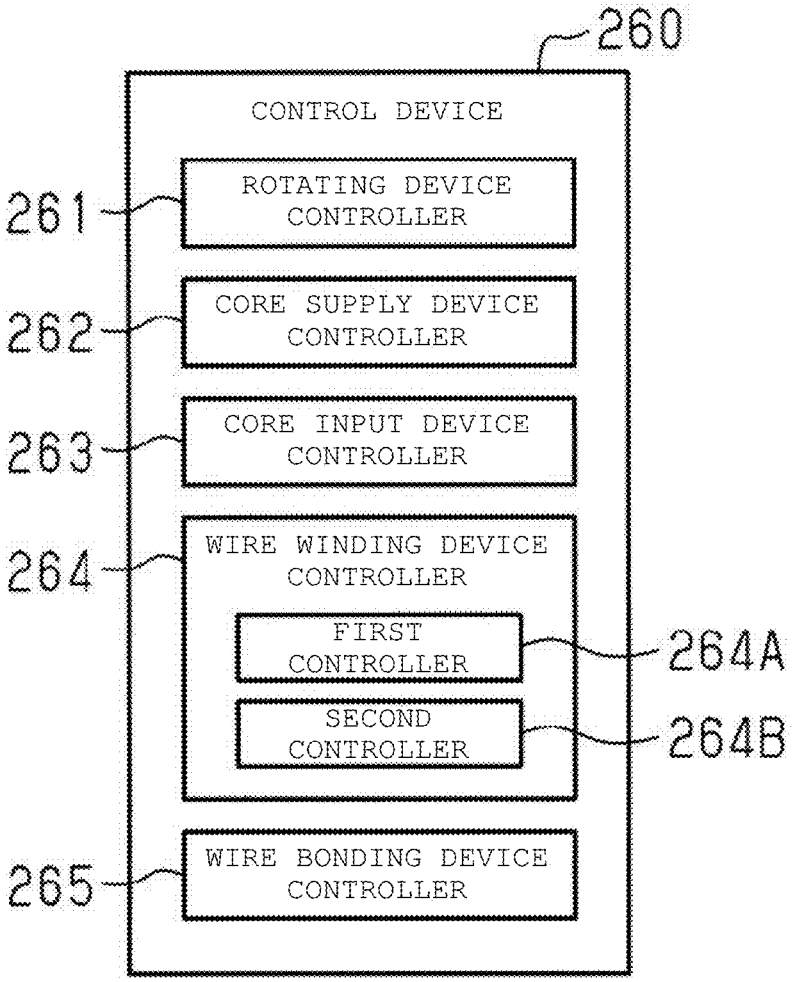
FIG. 14 is a functional block diagram of a control device.

As illustrated in FIG. 14, in order to control each of the above devices 40, 55, 60, 240, the control device 260 includes a rotating device controller 261, a core supply device controller 262, a core input device controller 263, a wire winding device controller 264, and a wire bonding device controller 265 as a functional unit. The rotating device controller 261 controls the rotating device to rotate the index table 32.

The core supply device controller 262 controls the core supply device to supply the core 310 to the core input device 55. The core input device controller 263 controls the core input device 55 to input the core 310 to the wire winding device 60. The wire winding device controller 264 controls the wire winding device 60 to wind the wire 320 around the core 310. The wire winding device controller 264 includes a first controller 264A. The first controller 264A controls the revolution drive unit 140 of the wire winding device 60 to revolve the core 310 around the nozzle 75, thereby winding the wire 320 inserted in the nozzle 75 around the core 310. The wire winding device controller 264 also includes a second controller 264B. The second controller 264B controls the rotation drive unit 120 of the wire winding device 60 to rotate the core 310 when the first controller 264A controls the revolution drive unit 140 to revolve the core 310 around the nozzle 75. The wire bonding device controller 265 controls the wire bonding device 240, and cuts the excessive wire 320 while bond the electrodes 313, 314 of the core 310 around which the first wire 321 and the second wire 322 are wound to the wire 321, 322.

Each of the controllers 261, 262, 263, 264, 265 includes a condition monitor, an operation storage, and an operation instructing unit (not illustrated). For example, each of the condition monitor and the operation instructing unit includes a Central Processing Unit (CPU) or a Micro Processing Unit (MPU). For example, the operation storage 132 includes a nonvolatile memory and a volatile memory.

The condition monitor monitors an operating condition of a control target device. Information about the operating condition detected by a camera or a sensor, which is provided in the control target device, is input to the condition monitor. The condition monitor outputs the current operating condition of the control target device to the operation storage based on the information about the operating condition of the control target device.

Various control programs and pieces of information used in various pieces of processing are stored in the operation storage. For example, the pieces of information used in various pieces of processing include the current operating condition of the control target device output from the condition monitor.

The operation instructing unit outputs an operation instructing signal to the control target device based on various control programs stored in the operation storage. For example, the operation instructing unit calculates a control target value based on the current operating condition of the control target device such that the operating condition of the control target device becomes a target operating condition, and performs feedback control to generate the operation instructing signal to the control target device.

<Method for Manufacturing Coil Component>

A method for manufacturing the coil component 300 in the coil component manufacturing apparatus 10 will be described below.

Figure 15:
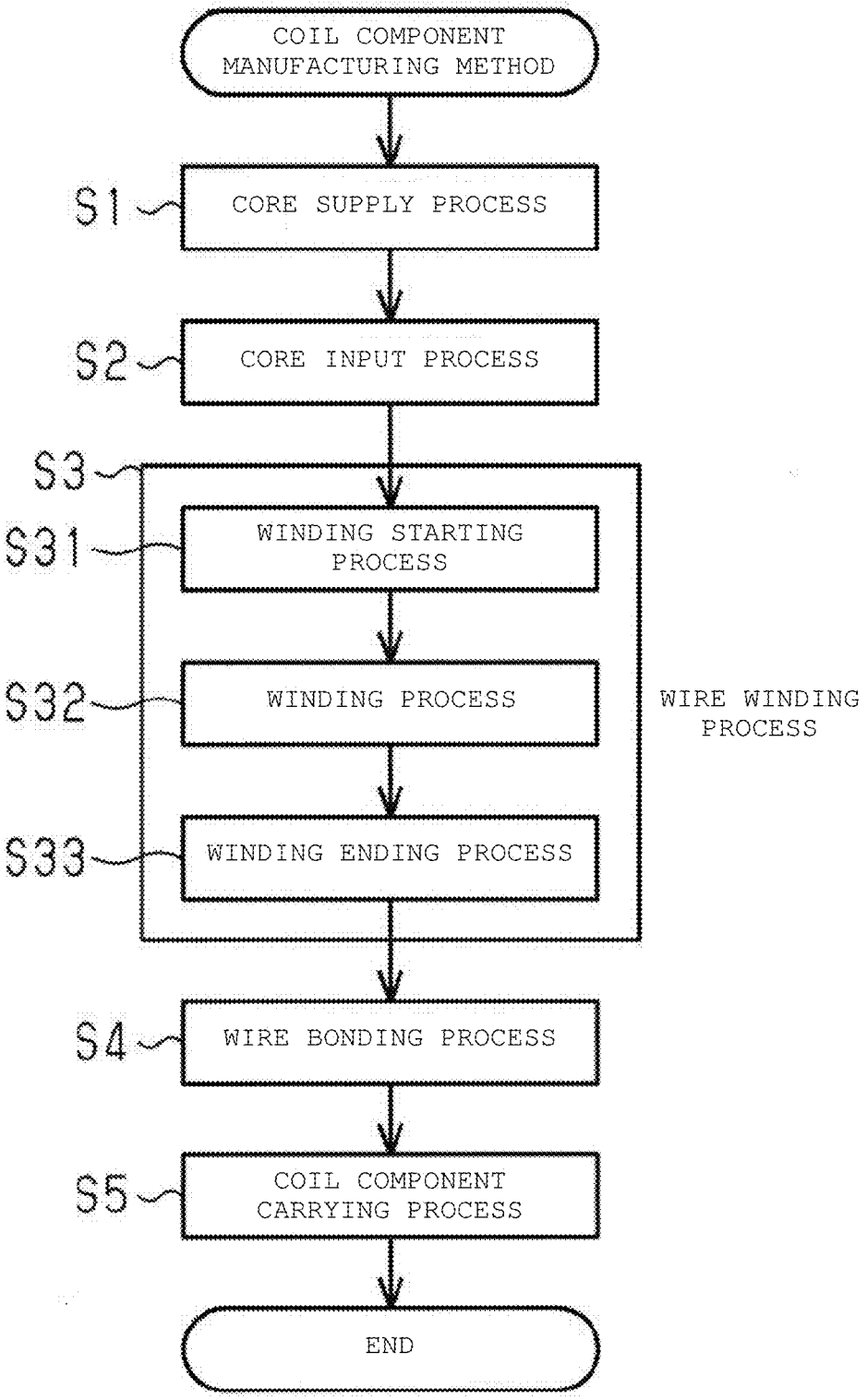
FIG. 15 is a flowchart of a method for manufacturing a coil component.

As illustrated in FIG. 15, the coil component manufacturing apparatus 10 manufactures a coil component 300 in which the first wire 321 and the second wire 322 are wound around the core 310 through a core supply process (step S1), a core input process (step S2), a wire winding process (step S3), a wire bonding process (step S4), and a coil component carrying process (step S5).

In the core supply process of step S1, the core supply device controller 262 of the control device 260 controls the core supply device 40. As described above, while the core 310 is supplied from the reserve unit 41 of the core supply device 40 to the feeder 42, the core supply device controller 262 drives the vibrator 43 to move the core 310 onto the circumferential-direction conveyer 42A and the straight advancing conveyer 42B. The core supply device controller 262 drives the sorter 45 based on the information input from the determination unit 44, thereby conveying only the cores 310 disposed in the predetermined direction to the other end of the straight advancing conveyer 42B. The direction, in which the electrodes 313, 314 are disposed in the upper portion and the first flange 311A is positioned on the other end side of the straight advancing conveyer 42B, is set to the predetermined direction in the embodiment. The core supply device controller 262 drives the carrier 47 to perform the suction from the suction hole, and sucks the first flange 311A of the core 310 to accommodate the core 310 conveyed to the other end of the straight advancing conveyer 42B in the accommodating recess 48.

When the core 310 is accommodated in the accommodation recess 48, the core supply device controller 262 stops the drive of the vibrator 43, and drives the motor 52 to slightly move the carrier 47. Consequently, the accommodation recess 48 of the carrier 47 in a vacant state, in which the core 310 is not accommodated yet, is faced to the other end of the straight advancing conveyer 42B. It can be determined whether the core 310 is accommodated in the accommodation recess 48 based on an increase in suction resistance of the suction hole, for example. Then, the core supply device controller 262 drives the vibrator 43 again to convey the core 310 to the other end of the straight advancing conveyer 42B, and moves the core 310 to the accommodation recess 48 by the suction from the suction hole of the carrier 47. The core supply device controller 262 accommodates the cores 310 in all the plurality of storage recesses 48 of the carrier 47 by repeating such processing. It can be determined whether the cores 310 are accommodated in all the accommodation recesses 48 based on the repetition of the above process by predetermined times (six times in the embodiment) or an image of the carrier 47 photographed with a camera, for example. When the cores 310 are accommodated in all the housing recesses 48 of the carrier 47, the core supply device controller 262 drives the motor 52 to deliver the carrier 47 to the core input device 55. Consequently, the core 310 is supplied to the core input device 55.

In the core input process of step S2, the core input device controller 263 of the control device 260 controls the core input device 55, and the wire winding device controller 264 of the control device 260 controls the wire winding device 60. When the carrier 47 is delivered, the core input device controller 263 drives the drive unit 56 to lower each suction nozzle 57, whereby the suction nozzle 57 abuts on the core 310. Then, the core input device controller 263 drives the suction nozzle 57 to start the suction from the suction hole, whereby the suction nozzle 57 sucks the core 310. Then, the core input device controller 263 drives the drive unit 56 to move the suction nozzle 57 onto the side of the grasping unit 90 of the wire winding device 60. At this point, the wire winding device controller 264 opens the grasping unit 90 of the wire winding device 60, and becomes the state in which the core 310 can be disposed.

Then, the core input device controller 263 moves the suction nozzle 57 to input the core 310 to the grasping unit 90. The core 310 is disposed such that the electrodes 313, 314 are located in the upper portion. At this point, the wire winding device controller 264 closes the grasping unit 90 to cause the grasping unit 90 to grasp the first flange 311A of the core 310. When the core 310 is grasped by the grasping unit 90, the core input device controller 263 stops the suction of the suction nozzle 57 to release the suction of the core 310, and drives the drive unit 56 to move the suction nozzle 57 to the original initial position. Through a series of pieces of processing, the plurality of cores 310 supplied from the core supply device 40 are put to the grasping unit 90 of the wire winding device 60.

In the wire winding process of step S3, the rotating device controller 261 first drives the direct drive motor 31 to rotate the index table 32. The rotating device controller 261 rotates the index table 32 such that the side wall 32B disposed on the left side of the base 20 is disposed on the front side of the base 20. Consequently, the grasping unit 90 to which the core 310 is input from the core input device 55 is disposed so as to face the nozzle moving device 69.

In the wire winding process, the plurality of wires 320 are wound around the core 310 through three steps of a winding starting process (step S31), a winding process (step S32), and a winding ending process (step S33).

Figure 16A:
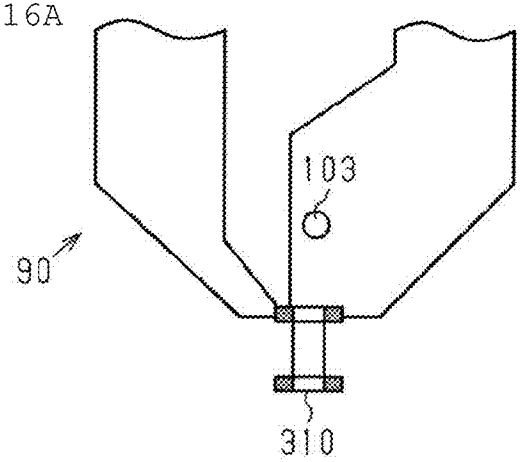
FIGS. 16A to 16D are schematic diagrams illustrating operation of the wire winding device in a winding process.
Figure 16B:
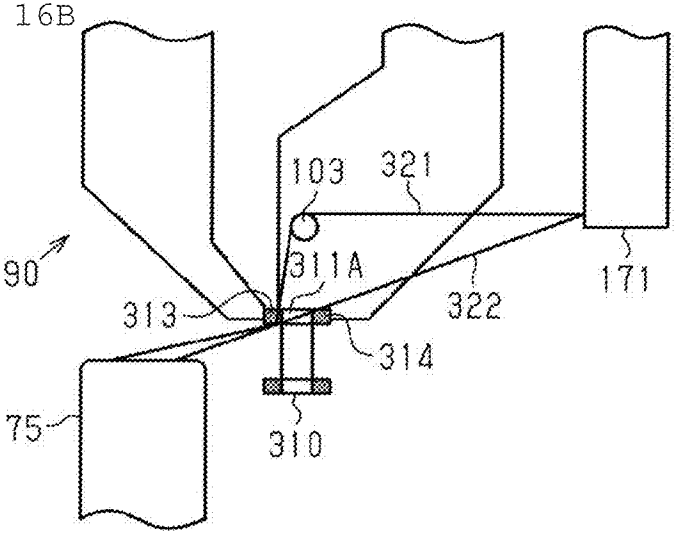

FIG. 16A illustrates the state in which the core 310 is grasped by the grasping unit 90. The grasping unit 90 includes a columnar hook 103 vertically provided upward. In the winding starting process, the wire winding device controller 264 drives the nozzle moving device 69 to move the nozzle 75 while controlling the tension controller 66 to feed the wire 320 from the wire bobbin 63 to the nozzle 75. Then, with the end portion of the winding start side of the wire 320 protruding from one end face of the nozzle 75, the end on the winding starting side is grasped by a starting line grasping body 171. At this point, the wire winding device controller 264 drives the nozzle moving device 69 to move the nozzle 75. Consequently, as illustrated in FIG. 16B, the first wire 321 is hooked on the first electrode 313 of the first flange 311A of the core 310 while hooked on the hook 103 of the grasping unit 90, and the second wire 322 is hooked on the second electrode 314 of the first flange 311A. The wire winding device controller 264 drives the nozzle moving device 69 to move the nozzle 75 such that the central axial line Ax2 of the nozzle 75 is disposed on the central axial line Ax3 of the revolution shaft 150 of the revolution drive unit 140.

Figure 16C:
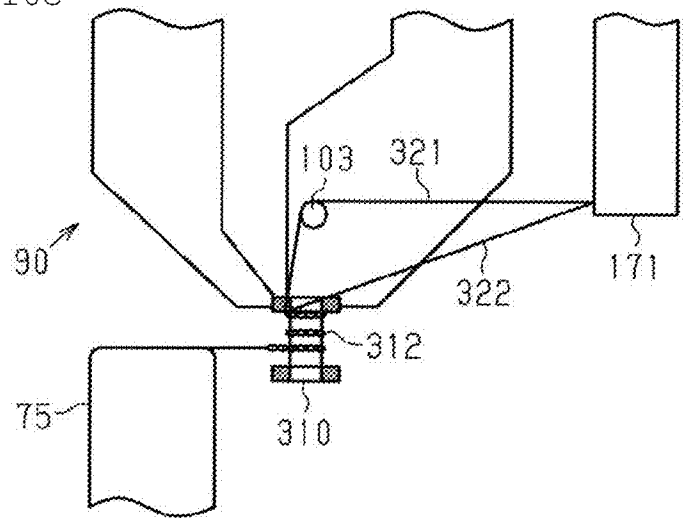
Figure 17:
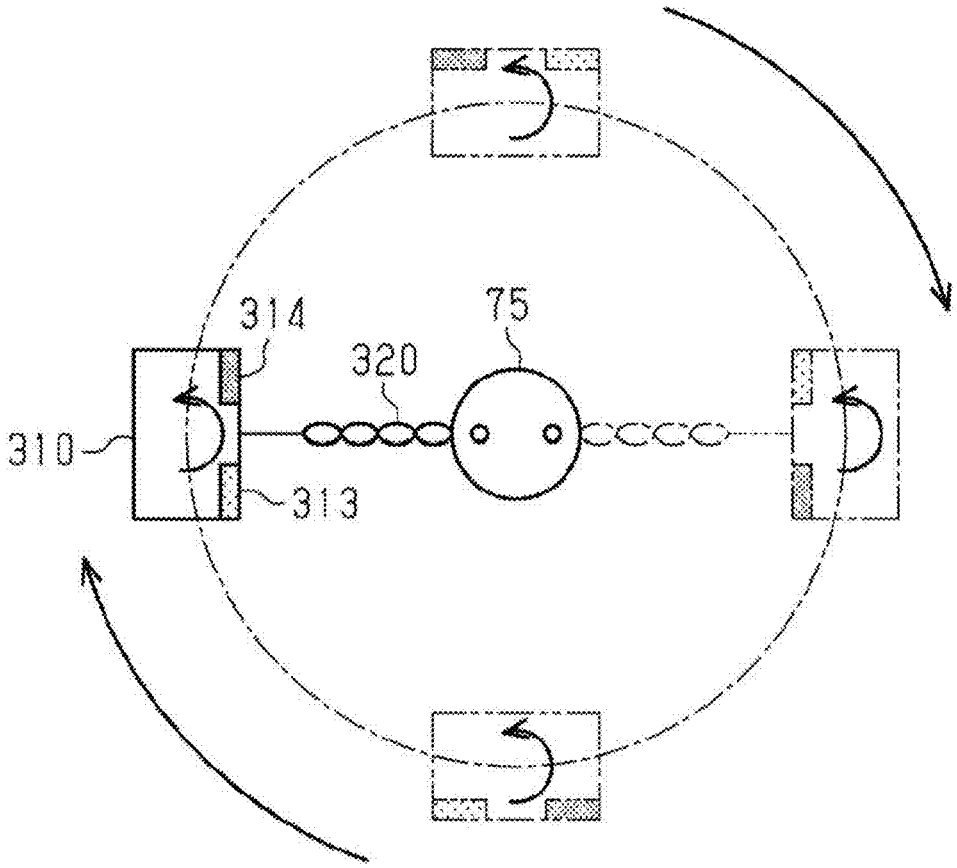
FIG. 17 is a schematic diagram illustrating a movement mode of a core in the winding process.

In the winding process, the first controller 264A of the wire winding device controller 264 controls the revolution drive unit 140 to revolve the core 310 around the nozzle 75, and the second controller 264B drives the rotation drive unit 120 to rotate the core 310, whereby the wire 320 is wound around the winding core 312 of the core 310 as illustrated in FIG. 16C. That is, as illustrated in FIG. 17, the first controller 264A revolves the core 310 clockwise with the nozzle 75 as the revolution center. While the first controller 264A revolves the core 310, the second controller 264B rotates the core 310 counterclockwise with the center of the winding core 312 of the core 310 as the rotation center. When the core 310 is revolved around the nozzle 75 to wind the wire 320 around the core 310, sometimes the wires 320 are twisted. In this case, the wires 320 are wound around the core 310 while twisted. In addition, the number of twists of the wires 320 changes by the rotation of the core 310. That is, by appropriately setting the number of rotations of the core 310 per revolution in the second controller 264B, the number of twists of the wires 320 can be adjusted when each of the wires 321, 322 is wound around the core 310. The second controller 264B appropriately sets the number of rotations per revolution based on the function required for the coil component 300 or the specification of the coil component 300 (for example, the size and shape of the core 310 and the diameters of the wires 321 and 322). The wire winding device 60 and the first controller 264A and the second controller 264B of the control device 260 constitute the winding device. The wire winding device controller 264 also controls the tension controller 66 when the wire 320 is wound around the core 310, and controls the tension of the wire 320 such that the wire 320 pulled out from the wire bobbin 63 has a predetermined tension. Consequently, the wire 320 is wound around the core 310 with predetermined tension.

Figure 16D:
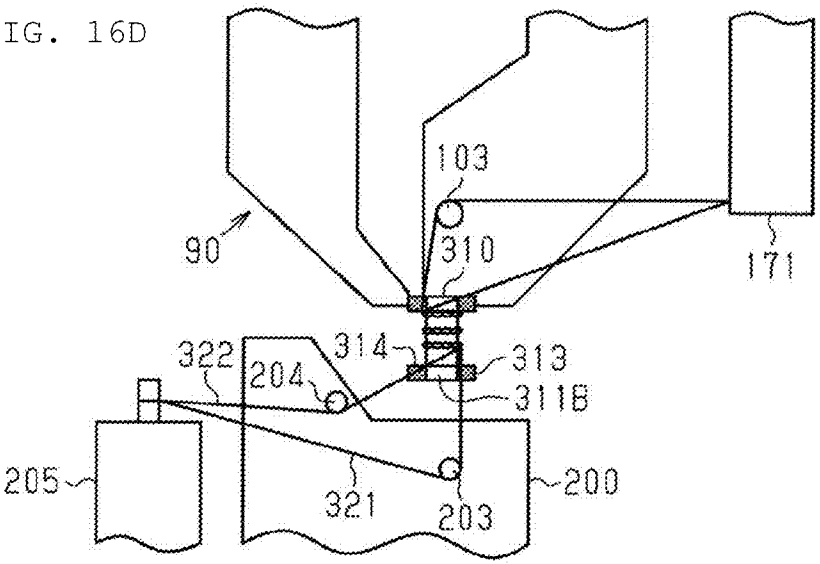

In the winding ending process, the wire winding device controller 264 drives the nozzle moving device 69 to move the nozzle 75, whereby the first wire 321 is hooked on a first hooking member 203 of the wire passage support 200 and the second wire 322 is hooked on a second hooking member 204 of the wire passage support 200 as illustrated in FIG. 16D. The first hooking member 203 and the second hooking member 204 are formed into a cylindrical shape vertically provided upward. When the wires 321, 322 are hooked, the first wire 321 is routed on the first electrode 313 of the second flange 311B of the core 310, and the second wire 322 is routed on the second electrode 314 of the second flange 311B. Thus, the first wire 321 is hooked on the first hooking member 203 and the second wire 322 is hooked on the second hooking member 204, whereby the first wire 321 is hooked on the first electrode 313 of the second flange 311B of the core 310 and the second wire 322 is hooked on the second electrode 314 of the second flange 311B. Then, the wire winding device controller 264 drives the nozzle moving device 69 to move the nozzle 75, and causes the ending line grasping body 205 to grasp the end on the winding ending side of each of the wires 321, 322.

In the wire bonding process of step S4, the rotating device controller 261 first drives the direct drive motor 31 to rotate the index table 32. The rotating device controller 261 rotates the index table 32 such that the side wall 32B disposed on the front side of the base 20 is disposed on the right side of the base 20. Consequently, the core 310 around which the wire 320 is wound by the wire winding device 60 is disposed on the side of the wire bonding device 240.

Figure 18:
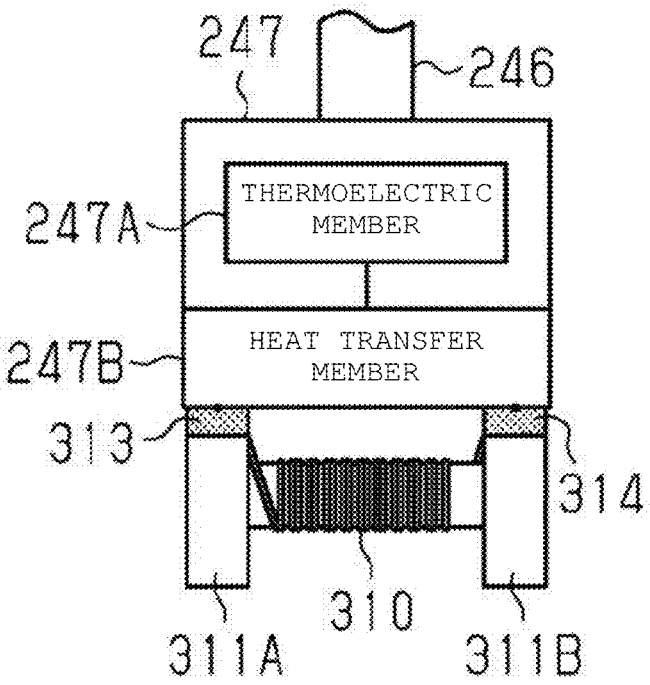
FIG. 18 is a schematic diagram illustrating a contact state between the second pressing unit and the core in a wire bonding process.

Then, the wire bonding device controller 265 of the control device 260 controls the wire bonding device 240. That is, the wire bonding device controller 265 drives the support section 244 and the moving unit 245 of the wire bonder 241 of the wire bonding device 240, and brings the second pressing unit 247 into contact with the core 310 as illustrated in FIG. 18. At this point, the wire bonding device controller 265 controls the operation of the moving unit 245 such that a load on which the second pressing unit 247 is pressed against the electrodes 313, 314 of the core 310 becomes a predetermined load. The wire bonding device controller 265 causes the thermoelectric member 247A of the second pressing unit 247 to generate heat. The wire bonding device controller 265 controls the heat generation of the thermoelectric member 247A such that a temperature of the heat transfer member 247B of the second pressing unit 247 (or a temperature of the thermoelectric member 247A) becomes a predetermined temperature. Consequently, the end on the winding starting side and the end on the winding ending side of the first wire 321 routed on the first electrode 313 of the core 310 are bonded to the first electrode 313, and the end on the winding starting side and the end on the winding ending side of the second wire 322 routed on the second electrode 314 are bonded to the second electrode 314. Thus, the first wire 321 is wired so as to connect the first electrodes 313, and the second wire 322 is wired so as to connect the second electrodes 314. After the first wire 321 and the first electrode 313 are electrically connected to each other while the second wire 322 and the second electrode 314 are electrically connected to each other, the wire bonding device controller 265 drives the moving unit 245 to separate the second pressing unit 247 from the core 310. The wire bonding device controller 265 drives the support 244 and the moving unit 245 to accommodate the moving unit 245, the first pressing unit 246, and the second pressing unit 247 in the support base 242. Then, the wire bonding device controller 265 drives the protrusion 252 of the wire cutter 250 to dispose the first wire cutting unit 253 and the second wire cutting unit 254 above the core 310.

Figure 19A:
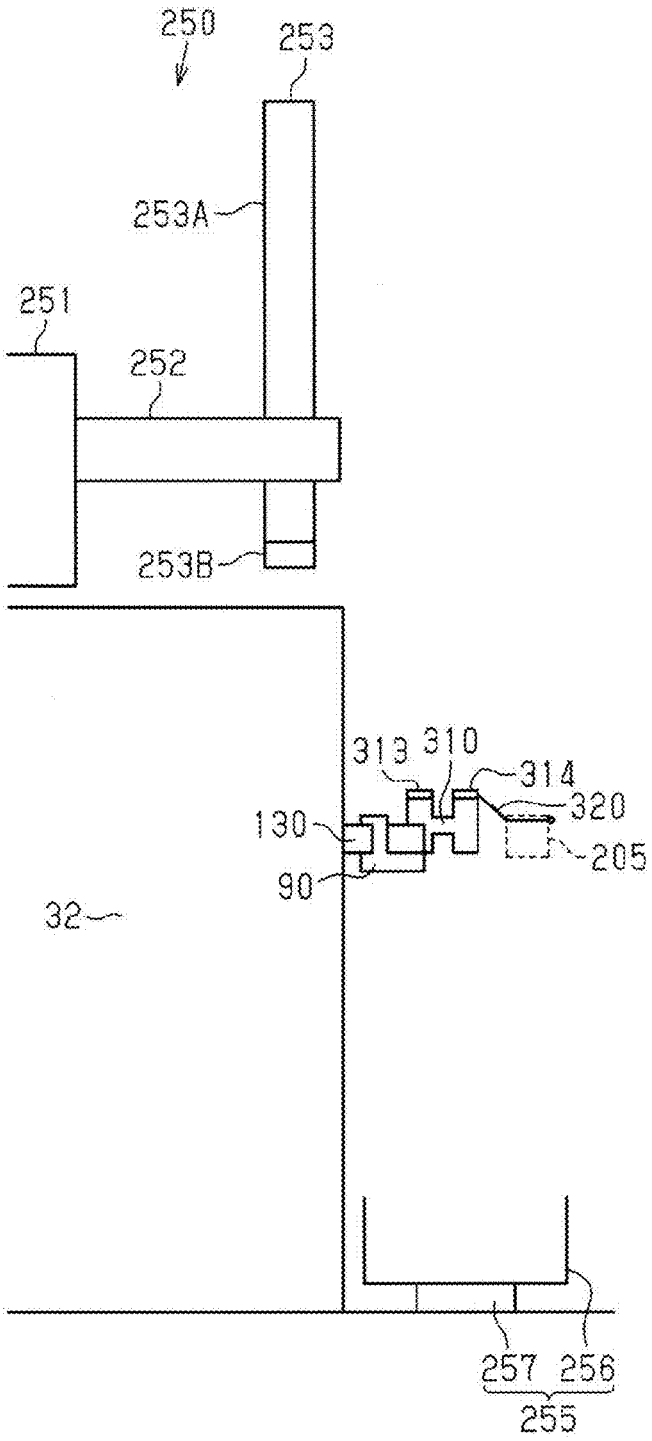
FIGS. 19A and 19B are side views illustrating the wire cut state in the wire bonding process.
Figure 19B:
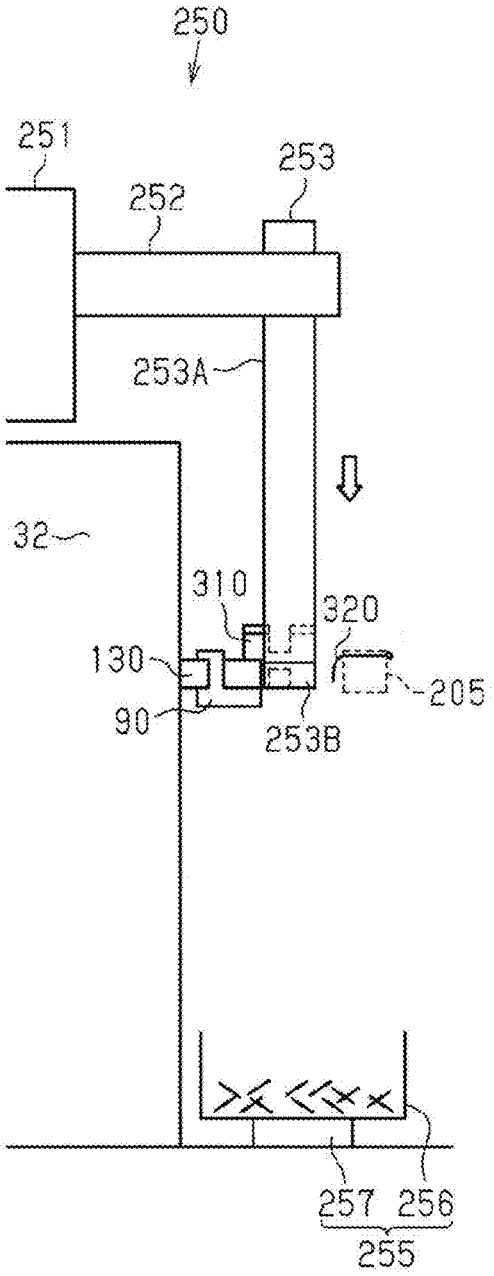

As illustrated in FIG. 19A, the wire cutter 250 of the wire bonding device 240 is disposed at an initial position where the first wire cutting unit 253 and the second wire cutting unit 254 are disposed above the index table 32. The wire bonding device controller 265 drives the protrusion 252 from this state to dispose the first wire cutting unit 253 and the second wire cutting unit 254 above the core 310. Then, as illustrated in FIG. 19B, the wire bonding device controller 265 drives the moving units 253A of the first wire cutting unit 253 and the second wire cutting unit 254 to move the cutting blades 253 downward. The cutting blade 253B is lowered to a position below each of the electrodes 313, 314 of the core 310. Consequently, in the first wire 321 and the second wire 322, the excessive wires 320 protruding outward from the electrodes 313, 314 of the core 310 are cut. The first wire cutting unit 253 cuts the excessive wire 320 on the winding ending side of the first wire 321 and the excessive wire 320 on the winding starting side of the second wire 322. The second wire cutting part 254 cuts the excessive wire 320 on the winding starting side of the first wire 321 and the excessive wire 320 on the winding ending side of the second wire 322. Consequently, the coil component 300 in which the first wire 321 and the second wire 322 are wound around the core 310 is manufactured. In this point, the end on the winding starting side of the wire 320 is cut off from the coil component 300, and grasped by the starting line grasping body 171. The end on the winding ending side of the wire 320 is cut off from the coil component 300 and grasped by the ending line grasping body 205.

Then, the wire bonding device controller 265 drives the moving units 253A of the first wire cutting unit 253 and the second wire cutting unit 254 to move the cutting blades 253B upward. Then, the wire bonding device controller 265 drives the protrusion 252 to dispose the first wire cutting unit 253 and the second wire cutting unit 254 at the initial position. The wire bonding device controller 265 drives the suction fan 257 to form the air flow toward the inside of the recovery box 256, and releases the grasp of the wire 320 by the ending line grasping body 205 while releasing the grasp of the wire 320 by the starting line grasping body 171. Consequently, the excessive wire 320 grasped by the starting line grasping body 171 falls down, and is recovered in the recovery box 256. The wire 320 grasped by the ending line grasping body 205 is not cut off from the nozzle 75, but protrudes from one end face of the nozzle 75. The end on the winding ending side protruding from one end face of the nozzle 75 is grasped by the starting line grasping body 171 as the end on the winding starting side of the wire 320 in the next wire winding process.

In the coil component carrying process of step S5, the rotating device controller 261 drives the direct drive motor 31 to rotate the index table 32. The rotating device controller 261 first rotates the index table 32 such that the side wall 32B disposed on the right side of the base 20 is disposed on the rear side of the base 20. Consequently, the grasping unit 90 grasping the coil component 300 is moved to the rear side of the base 20. The recovery unit is disposed on the rear side of the base 20. The wire winding device controller 264 opens the grasping unit 90 disposed on the rear side of the base 20 to release the grasp of the coil part 300, thereby recovering the coil component 300 in the recovery unit.

Thus, in the coil component manufacturing apparatus 10, the core supply process and the core input process are performed on the left side of the base 20, and the wire winding process is performed on the front side of the base 20. The wire bonding process is performed on the right side of the base 20, and the coil component carrying process is performed on the rear side of the base 20. Thus, the coil component manufacturing apparatus 10 sequentially performs the core supply process, the core input process, the wire winding process, the wire bonding process, and the coil component carrying process by rotating the index table 32, and manufactures the coil component 300.

The effects of the embodiment will be described.

(1) In the embodiment, in the winding process of winding the first wire 321 and the second wire 322 around the core 310, the nozzle 75 is not revolved around the core 310 but the core 310 is revolved around the nozzle 75. Consequently, when the first wire 321 and the second wire 322 are wound around the core 310, a change in distance between the nozzle 75 and the tensioner 64 can be prevented. Thus, compared with the case that the nozzle 75 is revolved around the core 310 to wind the first wire 321 and the second wire 322 around the core 310, a change in tension of the first wire 321 and the second wire 322 can be prevented between the nozzle 75 and the tensioner 64 to contribute to the prevention of durability degradation of the wires 321, 322.

(2) In the winding process, the first wire 321 and the second wire 322 can be prevented from being twisted between the nozzle 75 and the tensioner 64. Consequently, degradation of the coating film of the wires 321, 322 due to the interference of the twisted first wire 321 and second wire 322 between the nozzle 75 and the tensioner 64 can be also prevented.

(3) When the core 310 is revolved around the nozzle 75 to wind the plurality of wires 320 around the core 310, sometimes the wires 320 are twisted between the nozzle 75 and the core 310. In this case the wire 320 is wound around the core 310 while twisted. In addition, the number of twists of the wires 320 changes by the rotation of the core 310.

In the embodiment, the core 310 is rotated while revolved in the winding process. Consequently, the number of twists of the wires 320 can be changed when the first wire 321 and the second wire 322 are wound around the core 310.

(4) In the winding process, the core 310 is revolved around the nozzle 75, and thus the direction in which the wires 321, 322 are pull out from one end face of the nozzle 75 varies over 360°. Consequently, for example, when the core 310 is positioned on the side of the first wire passage hole 76 with respect to the central axial line Ax2 of the nozzle 75, the second wire 322 pulled out from the second wire passage hole 77 is routed so as to pass over the first wire passage hole 76 in front view. At this point, the second wire 322 passes through the center of the one end face of the nozzle 75, and is routed onto the side of the first wire passage hole 76. In the embodiment, one end face of the nozzle 75 has a spherical shape protruding forward toward the center, and thus the second wire 322 is routed so as to run on to one end face of the nozzle 75 when passing through the center of one end face of the nozzle 75. Consequently, in the center position, the second wire 322 is disposed in front of the opening 76A of the first wire passage hole 76. As a result, the second wire 322 passes ahead of the opening 76A of the first wire passage hole 76, and is routed on the core 310. On the other hand, the first wire 321 pulled out from the first wire passage hole 76 is routed on the core 310 without running on to the central side. As a result, the positions where the first wire 321 and the second wire 322 are routed are shifted from each other in the direction of the central axial line Ax2, and interference between the first wire 321 and the second wire 322 is prevented. Thus, entanglement of the first wire 321 and the second wire 322 due to the revolution of the core 310 around the nozzle 75 can be prevented.

The embodiment can be implemented in the following modifications. The following modifications can be made in an appropriate combination with each other.

Figure 20A:
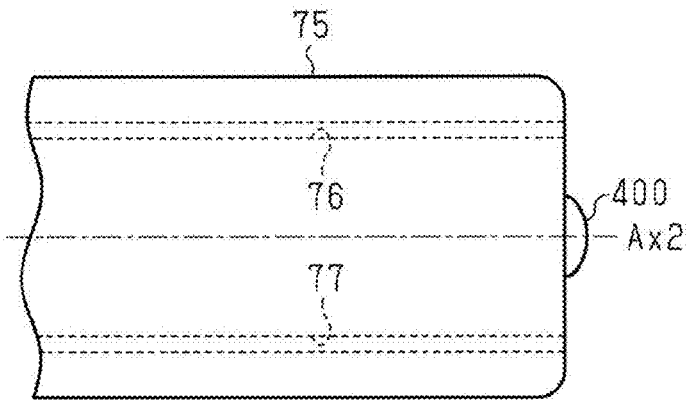
FIG. 20A is a plan view illustrating a configuration of a leading end in a modification of the nozzle.
Figure 20B:
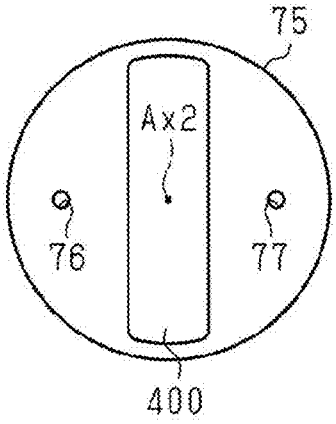
FIG. 20B is a front view of the nozzle.

The shape of one end face of the nozzle 75 is not limited to the described shape. For example, as illustrated in FIGS. 20A and 20B, one end face of the nozzle 75 is formed into a planar shape, and a convex curved surface 400 protruding forward in an arc shape may be provided on the front side (the right side in FIG. 20A) between the first wire passage hole 76 and the second wire passage hole 77 in the end face. As illustrated in FIG. 20B, the convex curved surface 400 extends in a direction (the vertical direction in FIG. 20B) orthogonal to the arrangement direction of the respective wire passage holes 76, 77, and both ends of the convex curved surface 400 extend to the vicinity of the circumferential edge on one end face of the nozzle 75. The same effect as the item (4) can be obtained as well in this configuration.

Figure 21:
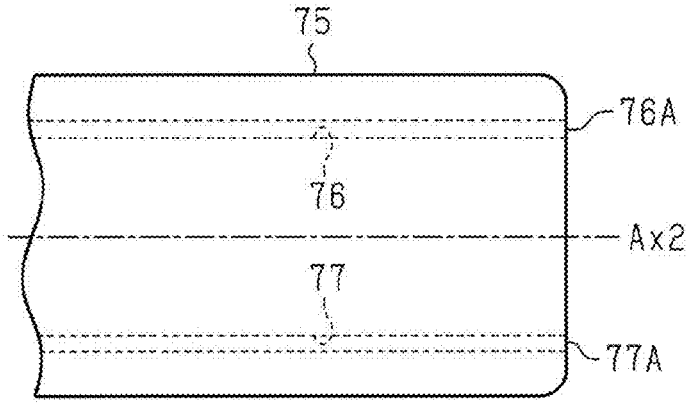
FIG. 21 is a plan view illustrating a configuration of a leading end in another modification of the nozzle.

In addition, as illustrated in FIG. 21, the convex curved surface 400 can be omitted in the above configuration. In this case, in one end face of the nozzle 75, the portion between the first wire passage hole 76 and the second wire passage hole 77, the opening 77A of the first wire passage hole 76, and the opening 77A of the second wire passage hole 77 are disposed at the same position in the direction of the central axial line Ax2 of the nozzle 75.

The disposition of the first wire passage hole 76 and the second wire passage hole 77 in the nozzle 75 can appropriately be changed. For example, the first wire passage hole 76 may be disposed in the center of the nozzle 75, and the second wire passage hole 77 may be disposed at a position eccentric from the center of the nozzle 75. Thus, the first wire passage hole 76 and the second wire passage hole 77 can be configured not to be symmetrically disposed with respect to the center of the nozzle 75.

Figure 22A:
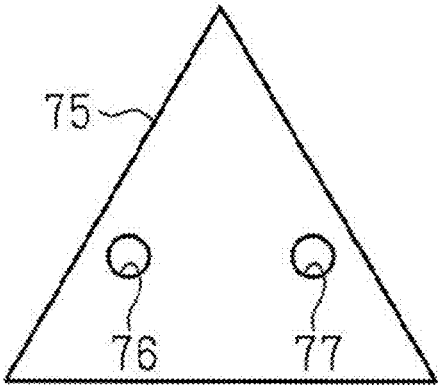
FIGS. 22A to 22E are front views illustrating configurations of nozzles according to other modifications.
Figure 22B:
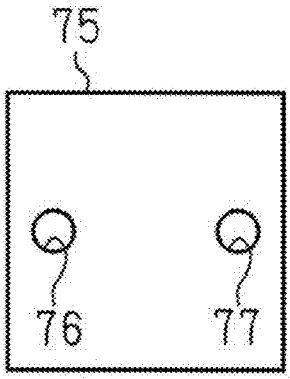
Figure 22C:
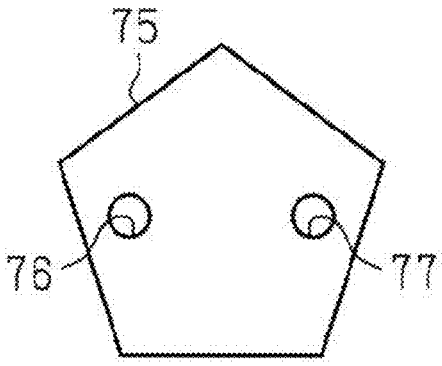
Figure 22D:
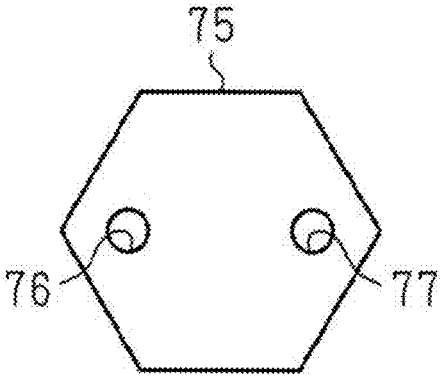
Figure 22E:
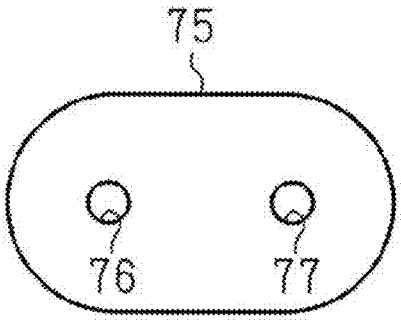

The sectional shape of the nozzle 75 can appropriately be changed. For example, the sectional shape of the nozzle 75 may be formed into a triangular shape as illustrated in FIG. 22A, or formed into a square shape as illustrated in FIG. 22B. The sectional shape of the nozzle 75 may be formed into a pentagonal shape as illustrated in FIG. 22C, or formed into a hexagonal shape as illustrated in FIG. 22D. Thus, the sectional shape of the nozzle 75 can be formed into a polygonal shape. The sectional shape of the nozzle 75 may be formed into an elliptical shape as illustrated in FIG. 22E. The nozzle 75 may be configured such that the sectional shape of the nozzle 75 changes in the axial direction. For example, the sectional shape at one end of the nozzle 75 can be formed into a triangular shape, and the sectional shape at the other end of the nozzle 75 can be formed into a square shape.

In the embodiment, the central axial line Ax2 of the nozzle 75 is disposed on the central axial line Ax3 of the revolution shaft 150. However, the disposition mode of the nozzle 75 is not limited to the embodiment. That is, the nozzle 75 needs not to be disposed on the central axial line Ax3 of the revolution shaft 150 as long as the nozzle 75 is disposed in the inner region of a revolution trajectory of the core 310. In this case, the nozzle 75 is disposed at the position eccentric from the revolution center of the core 310.

In the embodiment, in the winding process, the core 310 is revolved clockwise with the nozzle 75 as the revolution center, and the core 310 is rotated counterclockwise with the winding core 312 as the rotation center. The revolution direction and the rotation direction of the core 310 in the winding process are not limited to the embodiment.

Figure 23:
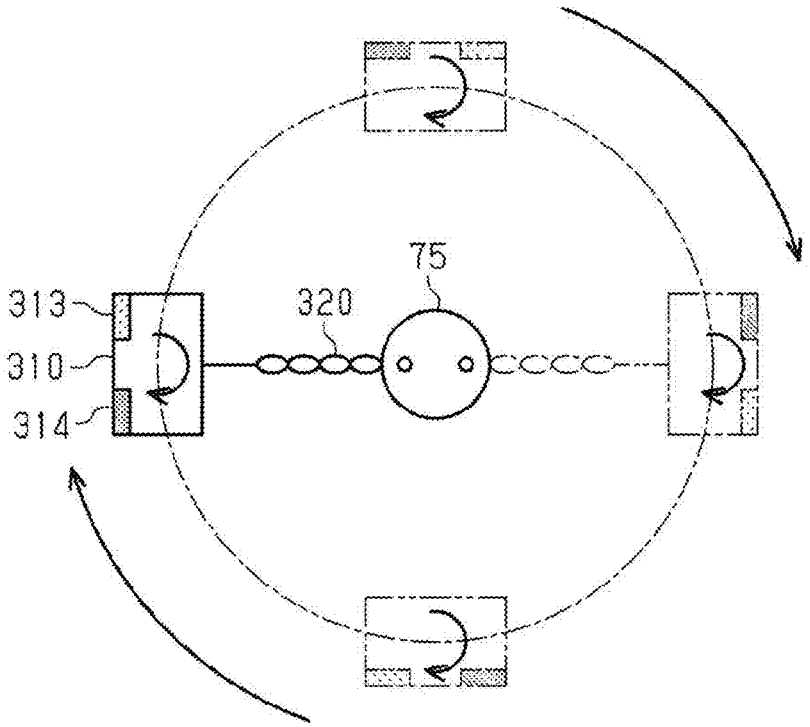
FIG. 23 is a schematic diagram illustrating another example of a revolution mode and a rotation mode of the core in the winding process.

For example, as illustrated in FIG. 23, the core 310 may be revolved clockwise with the nozzle 75 as the revolution center and the core 310 may be rotated clockwise with the winding core 312 as the rotation center. In this case, the revolution direction and the rotation direction of the core 310 are identical to each other.

Figure 24:
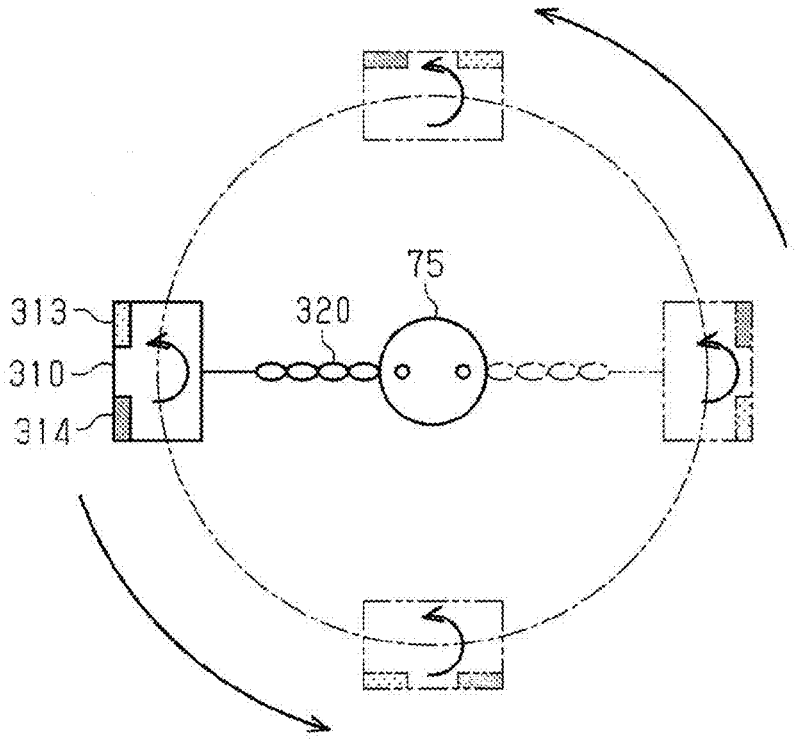
FIG. 24 is a schematic view illustrating another example of the revolution mode and the rotation mode of the core in the winding process.

As illustrated in FIG. 24, the core 310 may be revolved counterclockwise with the nozzle 75 as the revolution center and the core 310 may be rotated counterclockwise with the winding core 312 as the rotation center. In this case, the revolution direction and the rotation direction of the core 310 are also identical to each other.

It is needless to say that when the core 310 is revolved counterclockwise with the nozzle 75 as the revolution center, the core 310 may be rotated clockwise with the winding core 312 as the rotation center. The same effects as those of the items (1) to (3) can be obtained even in these configurations.

Figure 25:
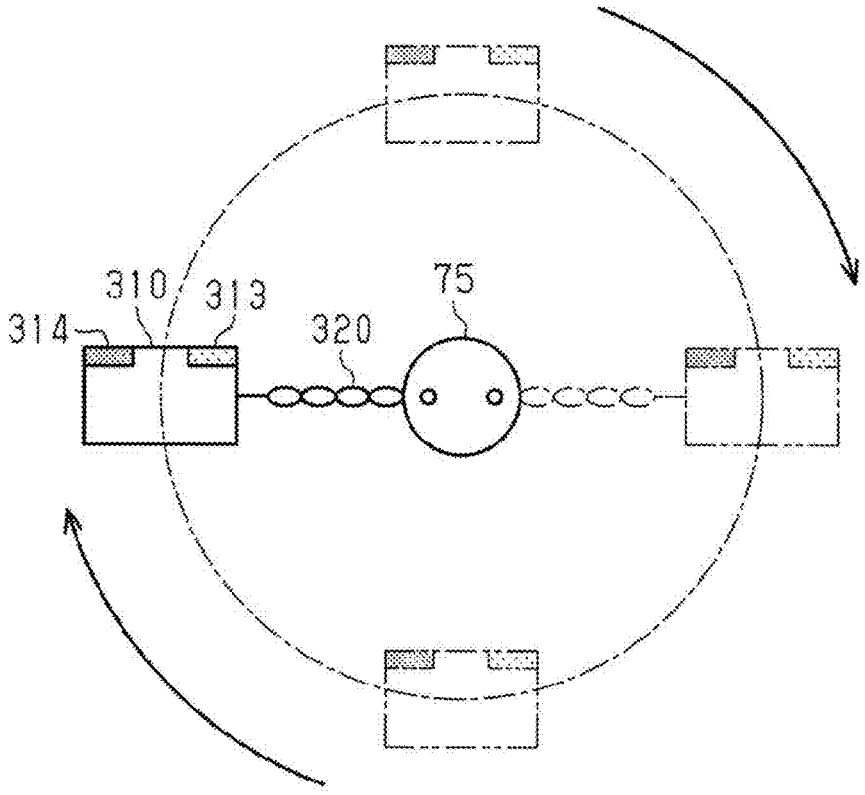
FIG. 25 is a schematic view illustrating another example of the revolution mode and the rotation mode of the core in the winding process.

As illustrated in FIG. 25, the core 310 may be revolved with the nozzle 75 as the center of revolution, but the core 310 is not rotated. In this case, the rotation drive unit 120 and the second controller 264B can be omitted in the embodiment. The same effects as those of the items (1) and (2) can be obtained as well in this configuration.

In the winding process, the wire 320 is wound around the core 310 while the grasping unit 90 grasps the first flange 311A of the core 310. However, the grasping portion of the core 310 can appropriately be changed. For example, the wire 320 may be wound around the core 310 while the grasping unit 90 grasps the second flange 311B of the core 310.

In the embodiment, in the winding starting process and the winding ending process, by moving the nozzle 75, the end on the winding starting side of each of the wires 321, 322 is grasped by the starting line grasping body 171 and the end on the winding ending side of each of the wires 321, 322 is grasped by the ending line grasping body 205. Instead of this configuration, an arm may be provided in the wire winding device 60 in order to grasp and move the first wire 321 and the second wire 322. In this configuration, the arm pulls out the wires 321, 322 from the nozzle 75, and the ending line grasping body 205 grasps the end on the winding ending side of each of the wires 321, 322 while the starting line grasping body 171 grasps the end on the winding starting side. In this case, the nozzle moving device 69 that moves the nozzle 75 is omitted, and a nozzle holding unit that holds the nozzle 75 in an immovable manner can be provided instead of the nozzle moving device 69. In the embodiment, at least three wires can be wound around the core.

Figure 26:
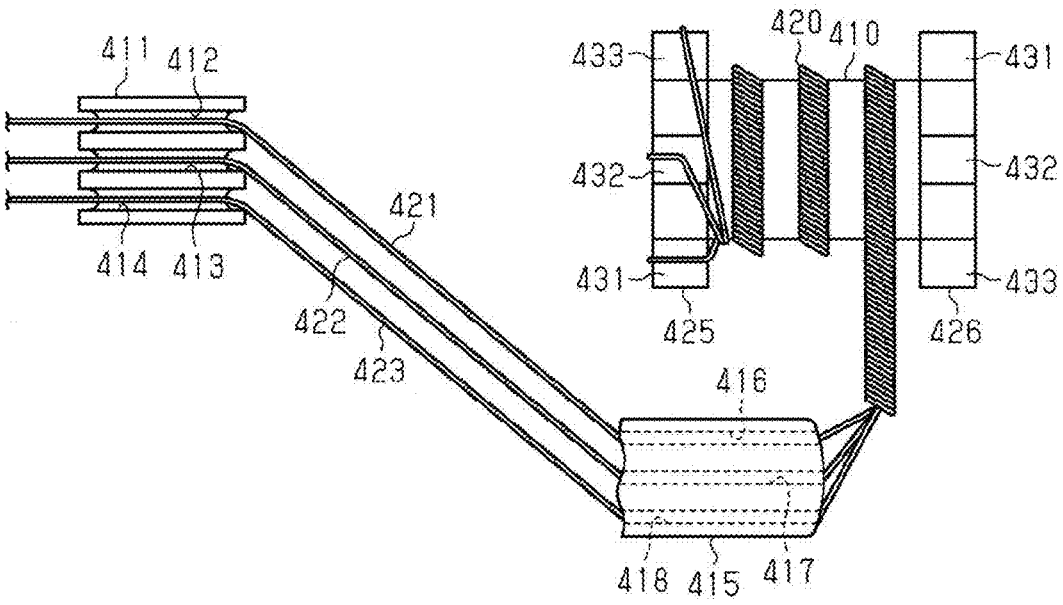
FIG. 26 is a schematic diagram illustrating a winding process of winding a wire around a core in a modification of a winding device.
Figure 27A:
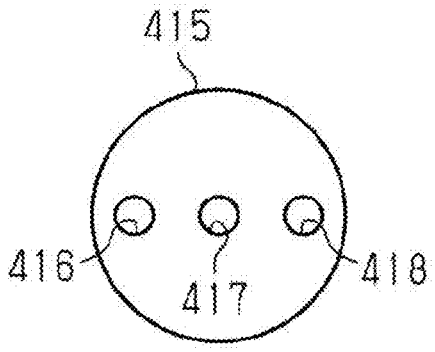
FIGS. 27A to 27D are front views illustrating configurations of modifications of the nozzle.
Figure 27B:
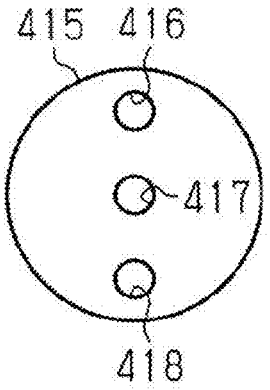
Figure 27C:
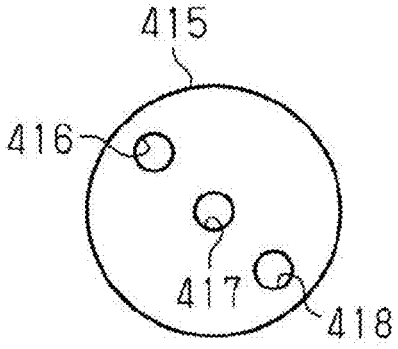
Figure 27D:
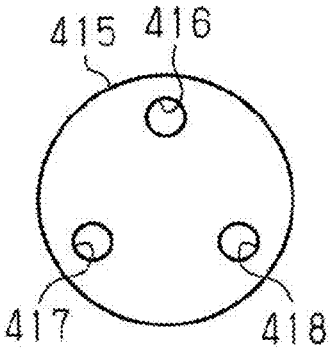

FIG. 26 illustrates a routing mode of a wire 420 when three wires 420 are wound around the core 410. In the configuration of FIG. 26, a first groove 412, a second groove 413, and a third groove 414 are formed in a pulley 411 of the tensioner 64. The three wires 420 pulled out from the wire bobbin 63 pass through the tension controller 66, and each of the three wires 420 is hung on one pulley 411. A first wire passage hole 416, a second wire passage hole 417, and a third wire passage hole 418 are made in a nozzle 415. The wire 420 hooked on the first groove 412 of the pulley 411 is supplied to the first wire passage hole 416 to constitute a first wire 421, and the wire 420 hooked on the second groove 413 of the pulley 411 is supplied to the second wire passage hole 417 to constitute a second wire 422. The wire 420 hooked on the third groove 414 of the pulley 411 is supplied to the third wire passage hole 418 to constitute a third wire 423. Each wire 420 supplied to the nozzle 415 is pulled out from the side (the right side in FIG. 26) of one end face of the nozzle 415, and wound around the core 410. A first electrode 431, a second electrode 432, and a third electrode 433 are formed in each of a first flange 425 and a second flange 426 of the core 410. The first wire 421 is hooked on the first electrode 431, the second wire 422 is hooked on the second electrode 432, and the third wire 423 is hooked on the third electrode 433.

As illustrated in FIG. 27, the disposition of the first wire passage hole 416, the second wire passage hole 417, and the third wire passage hole 418 of the nozzle 415 can appropriately be changed. For example, as illustrated in FIG. 27A, the wire passage holes 416, 417, 418 may be arranged in a line in the crosswise direction orthogonal to the vertical direction. As illustrated in FIG. 27B, the wire passage holes 416, 417, 418 can vertically be arranged in a line. As illustrated in FIG. 27C, the wire passage holes 416, 417, 418 may be arranged in a line in a direction inclined at a predetermined angle with respect to the vertical direction. Further, as illustrated in FIG. 27D, each of the wire passage holes 416, 417, 418 may be arranged so as to be located at an apex of a triangle. In these configurations, the positions of the wire passage holes 416, 417, 418 can be exchanged.

Figure 28:
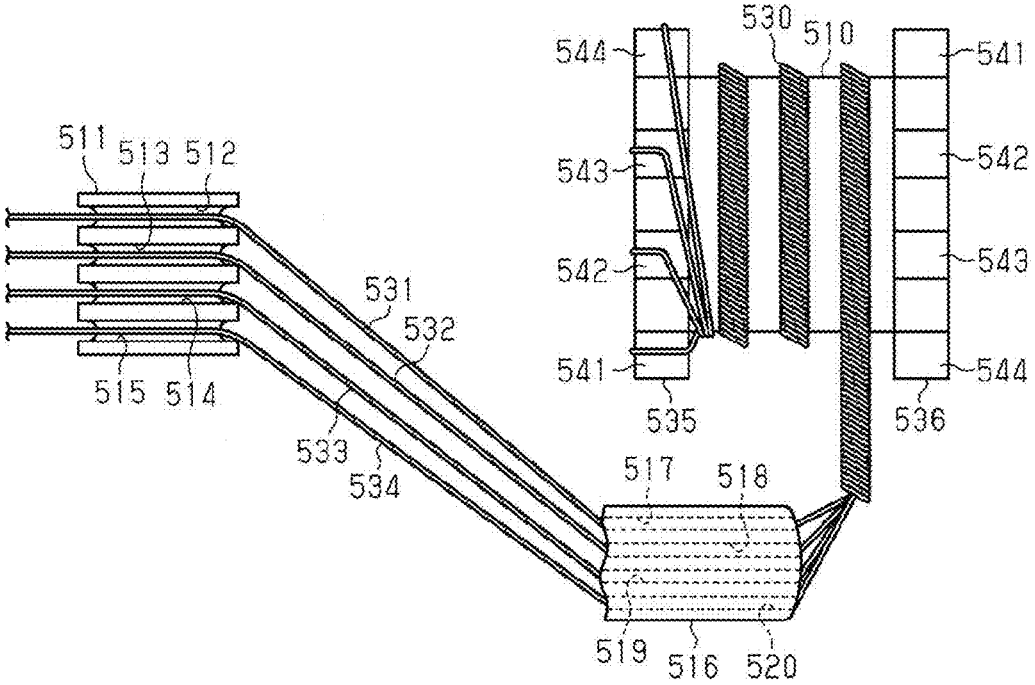
FIG. 28 is a schematic diagram illustrating a winding process of winding the wire around the core in another modification of the winding device.
Figure 29A:
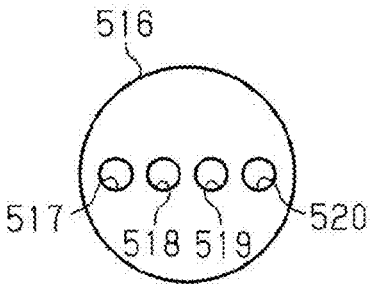
FIGS. 29A to 29E are front views illustrating configurations of modifications of the nozzle.
Figure 29B:
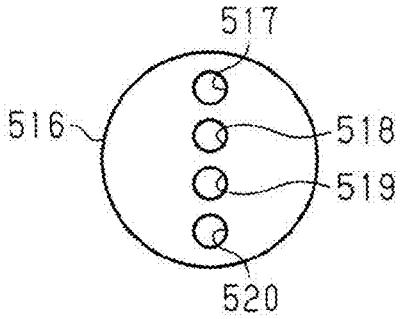
Figure 29C:
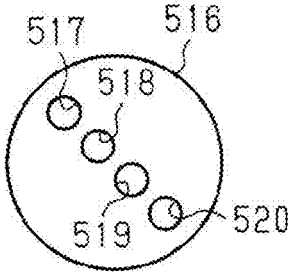
Figure 29D:
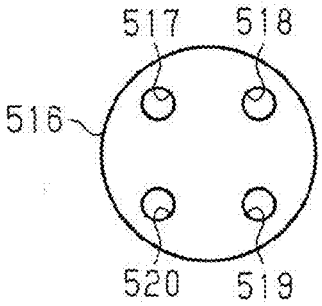
Figure 29E:
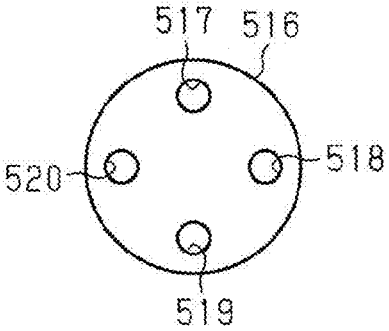

FIG. 28 illustrates a routing mode of a wire 530 when four wires 530 are wound around the core 510. In the configuration of FIG. 28, a first groove 512, a second groove 513, a third groove 514, and a fourth groove 515 are formed in a pulley 511 of the tensioner 64. The four wires 530 pulled out from the wire bobbin 63 pass through the tension controller 66, and each of the four wires 530 is hung on one pulley 511. A first wire passage hole 517, a second wire passage hole 518, a third wire passage hole 519, and a fourth wire passage hole 520 are formed in a nozzle 516. The wire 530 hooked on the first groove 512 of the pulley 511 is supplied to the first wire passage hole 517 to constitute a first wire 531, and the wire hooked on the second groove 513 of the pulley 511 is supplied to the second wire passage hole 518 to constitute a second wire 532. The wire hooked on the third groove 514 of the pulley 511 is supplied to the third wire passage hole 519 to constitute a third wire 533, and the wire hooked on the fourth groove 515 of the pulley 511 is supplied to the fourth wire passage hole 520 to constitute a fourth wire 534. Each wire 530 supplied to the nozzle 516 is pulled out from the side (the right side in FIG. 28) of one end face of the nozzle 516, and wound around the core 510. A first electrode 541, a second electrode 542, a third electrode 543, and a fourth electrode 544 are formed in each of a first flange 535 and a second flange 536 of the core 510. The first wire 531 is hooked on the first electrode 541, and the second wire 532 is hooked on the second electrode 542. The third wire 533 is hooked on the third electrode 543, and the fourth wire 534 is hooked on the fourth electrode 544.

As illustrated in FIG. 29, the disposition of the first wire passage hole 517, the second wire passage hole 518, the third wire passage hole 519, and the fourth wire passage hole 520 of the nozzle 516 can appropriately be changed. For example, as illustrated in FIG. 29A, the wire passage holes 517, 518, 519, 520 may be arranged in a line in the crosswise direction orthogonal to the vertical direction. As illustrated in FIG. 29B, the wire passage holes 517, 518, 519, 520 can vertically be arranged in a line. As illustrated in FIG. 29C, the wire passage holes 517, 518, 519, 520 may be arranged in a line in a direction inclined at a predetermined angle with respect to the vertical direction. Further, as illustrated in FIG. 29D, each of the wire passage holes 517, 518, 519, 520 may be arranged so as to be located at a vertex of a quadrangle. As illustrated in FIG. 29E, each of the wire passage holes 517, 518, 519, 520 may be arranged so as to be located at a vertex of a rhomboid. In these configurations, the positions of the wire passage holes 517, 518, 519, 520 can be exchanged.

Figure 30A:
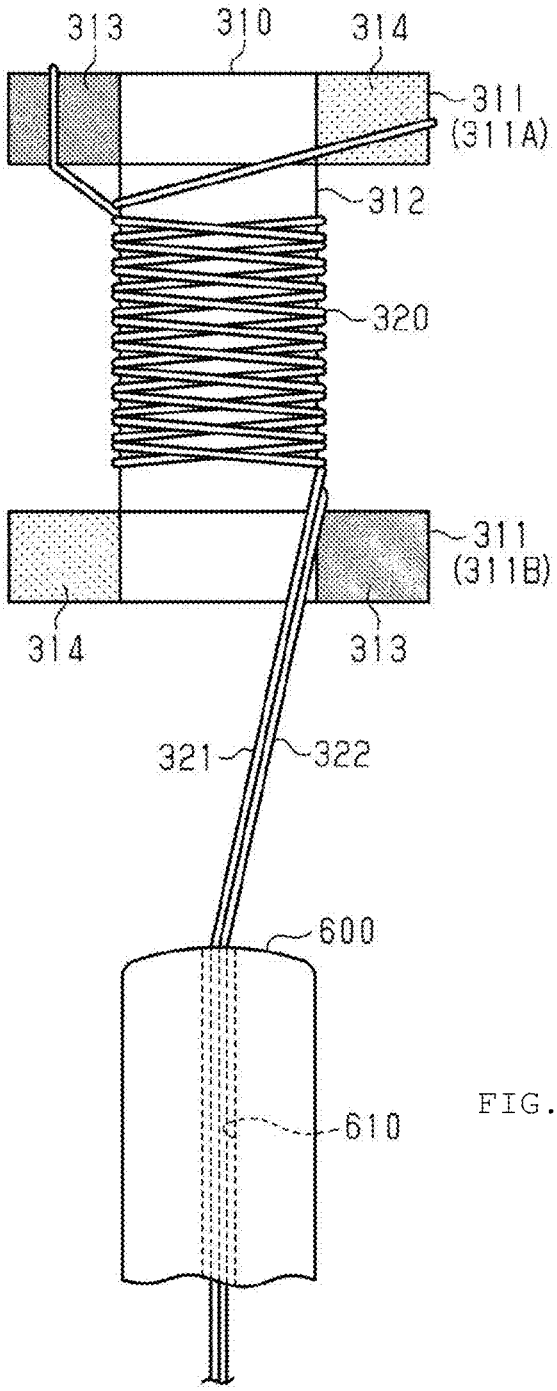
FIG. 30A is a schematic view illustrating a winding process of winding a wire to a core in a modified example of a winding device.
Figure 30B:
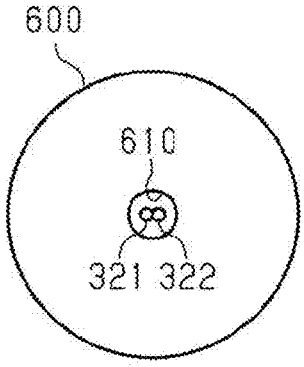
FIG. 30B is a front view of a nozzle in the modified example.

In the embodiment, the wire passage holes are formed as many as the wires 320, 420, 530 supplied to the nozzles 75, 415, 516. However, the number of wire passage holes formed in the nozzle is not necessarily matched with the number of wires. For example, in the wire winding device 60, as illustrated in FIG. 30B, one wire passage hole 610 is formed into a nozzle 600, and the two wires 320 of the first wire 321 and the second wire 322 can be inserted in the wire passage hole 610. That is, the number of wire passage holes formed in the nozzle 600 is smaller than the number of wires. The inner diameter of the wire passage hole 610 is larger than a sum of the outer diameter of the first wire and the outer diameter of the second wire. In this configuration, as illustrated in FIG. 30A, the first wire 321 and the second wire 322 are delivered from the wire passage hole 610 to the core 310 while being adjacent to each other. The number of the wire passage holes formed in the nozzle can be larger than the number of wires.

Figure 31A:
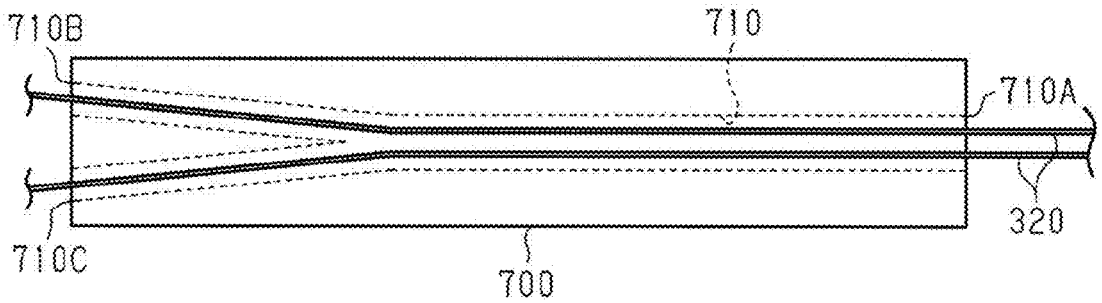
FIGS. 31A to 31C are schematic diagrams illustrating modifications of a formation mode in a wire passage hole.
Figure 31B:
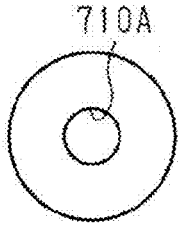
Figure 31C:
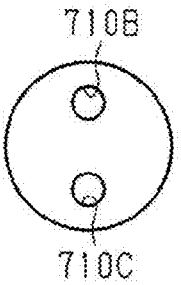

As illustrated in FIG. 31A, one end side (the right end side in FIG. 31) in which the wire 320 is inserted is formed into a single hole shape in the wire passage hole 710 formed in the nozzle 700, and the other end side (the left end side in FIG. 31) from which the 320 is pulled out may be branched to form two hole shapes. In this configuration, one opening 710A is formed in the end face on one end side as illustrated in FIG. 31B, and two openings 710B, 710B are formed in the end face on the other end side as illustrated in FIG. 31C. In this configuration, in the nozzle 700, the plurality of wires 320 inserted in the same opening 710A can be pulled out from the different openings 710B, 710C.

Figure 32A:
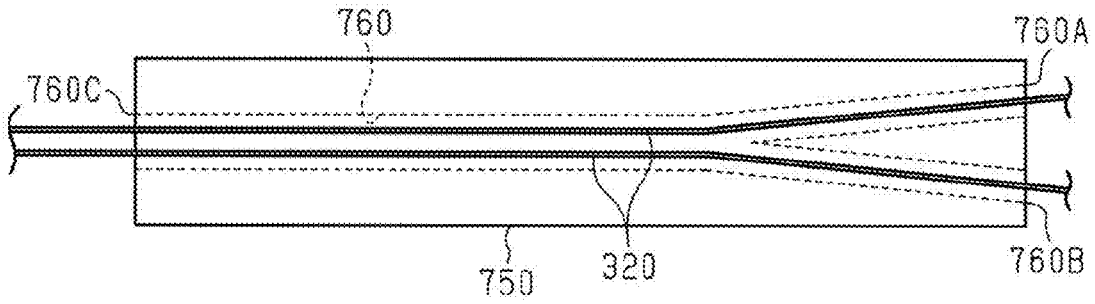
FIGS. 32A to 32C are schematic diagrams illustrating modifications of the formation mode in the wire passage hole.
Figure 32B:
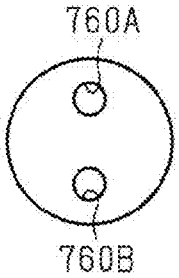
Figure 32C:
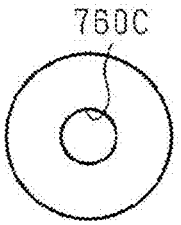

As illustrated in FIG. 32A, in the wire passage hole 760 formed in the nozzle 750, one end side (the right end side in FIG. 32) in which the wire 320 is inserted is formed into two hole shapes, and the two passage holes are joined to form one hole shape on the other end side (the left end side in FIG. 32) from which the wire 320 is pulled out. In this configuration, two openings 760A, 760B are formed in the end face on one end side as illustrated in FIG. 32B, and one opening 760C is formed in the end face on the other end side as illustrated in FIG. 32C. In this configuration, in the nozzle 750, the plurality of wires 320 inserted in the different openings 760A, 760B can be pulled out from the same opening 760C.

What is claimed is:

1. A method for manufacturing a coil component, the method comprising:

winding wires, supplied from a wire supply source to a nozzle through a tensioner, around a core by revolving the core around the nozzle.

2. The method for manufacturing a coil component according to claim 1, wherein during the winding, the core is rotated in a direction same as or opposite to a revolution direction of the core.

3. The method for manufacturing a coil component according to claim 2, wherein during the winding, the core is rotated in the direction same as the revolution direction of the core.

4. The method for manufacturing a coil component according to claim 2, wherein during the winding, the core is rotated in the direction opposite to the revolution direction of the core.

5. A winding device that manufactures a coil component in which wires are wound around a core, the winding device comprising:

a nozzle in which the wires pulled out from a wire supply source are inserted;

a tensioner configured to adjust tension of the wires inserted in the nozzle;

a holder configured to hold the core;

a revolution driver configured to revolve the core around the nozzle; and a first controller configured to control the revolution driver to revolve the core around the nozzle, and wind the wires inserted in the nozzle around the core.

6. The winding device according to claim 5, further comprising:

a rotation driver configured to rotate the core in a direction same as or opposite to a revolution direction of the core as revolved by the revolution driver; and a second controller configured to control the rotation driver to rotate the core when the first controller controls the revolution driver to revolve the core around the nozzle.

7. The winding device according to claim 6, wherein:

the second controller is configured to control the rotation driver to rotate the core in the direction same as the revolution direction of the core when the first controller controls the revolution driver to revolve the core around the nozzle.

8. The winding device according to claim 6, wherein:

the second controller is configured to control the rotation driver to rotate the core in the direction opposite to the revolution direction of the core when the first controller controls the revolution driver to revolve the core around the nozzle.

* * * * *